US010112397B2

(12) United States Patent
Morimoto et al.

(10) Patent No.: US 10,112,397 B2
(45) Date of Patent: Oct. 30, 2018

(54) LIQUID JETTING APPARATUS

(71) Applicant: BROTHER KOGYO KABUSHIKI KAISHA, Nagoya-shi, Aichi-ken (JP)

(72) Inventors: Nao Morimoto, Nagoya (JP); Mikio Ogawa, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/707,318

(22) Filed: Sep. 18, 2017

(65) Prior Publication Data

US 2018/0086121 A1 Mar. 29, 2018

(30) Foreign Application Priority Data

Sep. 23, 2016 (JP) ..... 2016-185784

(51) Int. Cl.
*B41J 2/165* (2006.01)

(52) U.S. Cl.
CPC ..... *B41J 2/16511* (2013.01); *B41J 2/16505* (2013.01); *B41J 2/16547* (2013.01); *B41J 2002/16514* (2013.01); *B41J 2002/16582* (2013.01)

(58) Field of Classification Search
CPC ..... B41J 2/16511; B41J 2/16505; B41J 2/16547; B41J 2002/16582; B41J 2002/16514
See application file for complete search history.

(56) References Cited

U.S. PATENT DOCUMENTS

2003/0227505 A1* 12/2003 Tanaka ..... B41J 2/16511 347/29
2007/0019029 A1* 1/2007 Hiruma ..... B41J 2/16511 347/29

FOREIGN PATENT DOCUMENTS

JP 2000-211148 A 8/2000
JP 2010-179661 A 8/2010

* cited by examiner

*Primary Examiner* — Geoffrey Mruk
(74) *Attorney, Agent, or Firm* — Merchant & Gould P.C.

(57) ABSTRACT

There is provided a liquid jetting apparatus including: a liquid jetting head; a carriage; a cap; a cap switching device switching the cap between a capping state and an uncapping state; a carriage blocker movable between a first position not contacting carriage, and a second position blocking movement of the carriage in a first direction; and a contacting portion locatable, in the uncapping state, at a third position at which the contacting portion is not in contact with carriage, and locatable, in the capping state, at a fourth position at which, under a condition that the blocked carriage rotates around an axis perpendicular to a liquid jetting surface with the carriage blocker as a supporting point, the contacting portion is capable of contacting the rotating carriage. The contacting portion is configured to move integrally with the cap in a plane parallel to the liquid jetting surface.

14 Claims, 20 Drawing Sheets

LIQUID JETTING APPARATUS

CROSS REFERENCE TO RELATED APPLICATION

The present application claims priority from Japanese Patent Application No. 2016-185784 filed on Sep. 23, 2016 the disclosure of which is incorporated herein by reference in its entirety.

BACKGROUND

Field of the Invention

The present invention relates to a liquid jetting apparatus which jets a liquid from nozzles.

Description of the Related Art

As an example of a liquid jetting apparatus which jets a liquid from nozzles, there is a publicly known ink-jet printer which jets an ink from nozzles so as to perform printing. For example, a certain ink-jet printer is configured such that a carriage having a recording head mounted thereon is located at a maintenance position on the right side relative to a recording position at which recording is performed; in this state, a lip portion of a nozzle cap is made to have a tight contact with the lower surface of the recording head. Further, in this situation, a carriage lock is located at a position at which an upper end portion of the carriage lock faces a portion of the carriage. With this, in a case that the carriage makes attempt to move to the left side (to the side of the recording position), the carriage lock makes contact with the portion of the carriage, thereby preventing the leftward movement of the carriage.

SUMMARY

Here, in the above-described ink-jet printer, for example in such a case that the posture of the ink-jet printer is changed during transportation, any external force in the moving direction in which the ink-jet printer is being moved might be applied to the carriage, in some cases. In the above-described ink-jet printer, although the movement of the carriage is prevented by the carriage lock, the carriage lock makes contact only with a portion of the carriage, and there is some looseness or spacing distance between the carriage and a guide rail supporting the carriage. Therefore, in a case that the external force in the moving direction is applied to the carriage, the carriage of which movement is prevented by the carriage lock rotates, with the carriage lock as the supporting point, in some cases. In such a situation, if the force applied to the carriage is great, the carriage (recording head) and the nozzle cap are moved relative to each other against the frictional force generated therebetween, which in turn leads such a fear that the lip portion of the nozzle cap might make contact with the nozzles.

An object of the present teaching is to provide a liquid jetting apparatus capable of preventing the recording head and the nozzle cap from moving relative to each other, even in a case that any large external force is applied to the carriage.

According to an aspect of the present teaching, there is provided a liquid jetting apparatus configured to jet liquid toward a recording medium, including: a liquid jetting head including a liquid jetting surface and a plurality of nozzles arranged in the liquid jetting surface; a carriage on which the liquid jetting head is mounted, and which is movable along a guide rail extending in a first direction parallel to the liquid jetting surface; a cap configured to cover the plurality of nozzles; a cap switching device configured to move the cap relative to the liquid jetting head in a second direction crossing the liquid jetting head and to perform switching between a capping state and an uncapping state, the capping state being a state in which the cap is in contact with the liquid jetting head to cover the plurality of nozzles, and the uncapping state being a state in which the cap is separated away from the liquid jetting head; a carriage blocker configured to move between a first position at which the carriage blocker is not in contact with carriage, and a second position at which the carriage blocker is in contact with the carriage to block movement of the carriage in the first direction; and a contacting portion which is located, in the uncapping state, at a third position at which the contacting portion is not in contact with carriage, and which is located, in the capping state, at a fourth position at which, under a condition that the carriage, of which movement in the first direction is blocked by the carriage blocker located at the second position, rotates around an axis perpendicular to the liquid jetting surface with the carriage blocker as a supporting point, the contacting portion is capable of contacting with the rotating carriage. The contacting portion is configured to move integrally with the cap in a plane parallel to the liquid jetting surface.

In a case that the external force in the first direction is applied to the carriage, the carriage makes contact with the carriage blocker, which in turn prevents the movement of the carriage in the first direction by this contact with the carriage blocker. In this situation, since there is some looseness between the carriage and the guide rail, the carriage rotates in the plane parallel to the liquid jetting surface with the carriage blocker as the supporting point, in some case. Here, if such a case is presumed that any contacting portion is not provided, then if the force applied to the carriage is large, there is such a fear that the carriage and the cap might be moved in the first direction relative to each other against the frictional force between the liquid jetting head and the cap, and that the cap might make contact with the nozzles of the liquid jetting head.

In the present teaching, in a case that the carriage, of which movement in the first direction is blocked or regulated by the carriage blocker, rotates in the plane parallel to the liquid jetting surface with the carriage blocker as the support point and that such a rotated carriage makes contact with the contacting portion, the carriage and the cap rotate integrally. Accordingly, even in a case that any large external force is applied to the carriage, the positional relationship in the first direction between the carriage and the cap is not changed, thereby making it possible to prevent the cap from making contact with the nozzles.

DESCRIPTION OF THE EMBODIMENTS

An embodiment of the present teaching will be explained as follows.

<Schematic Configuration of Printer>

Figure 1:
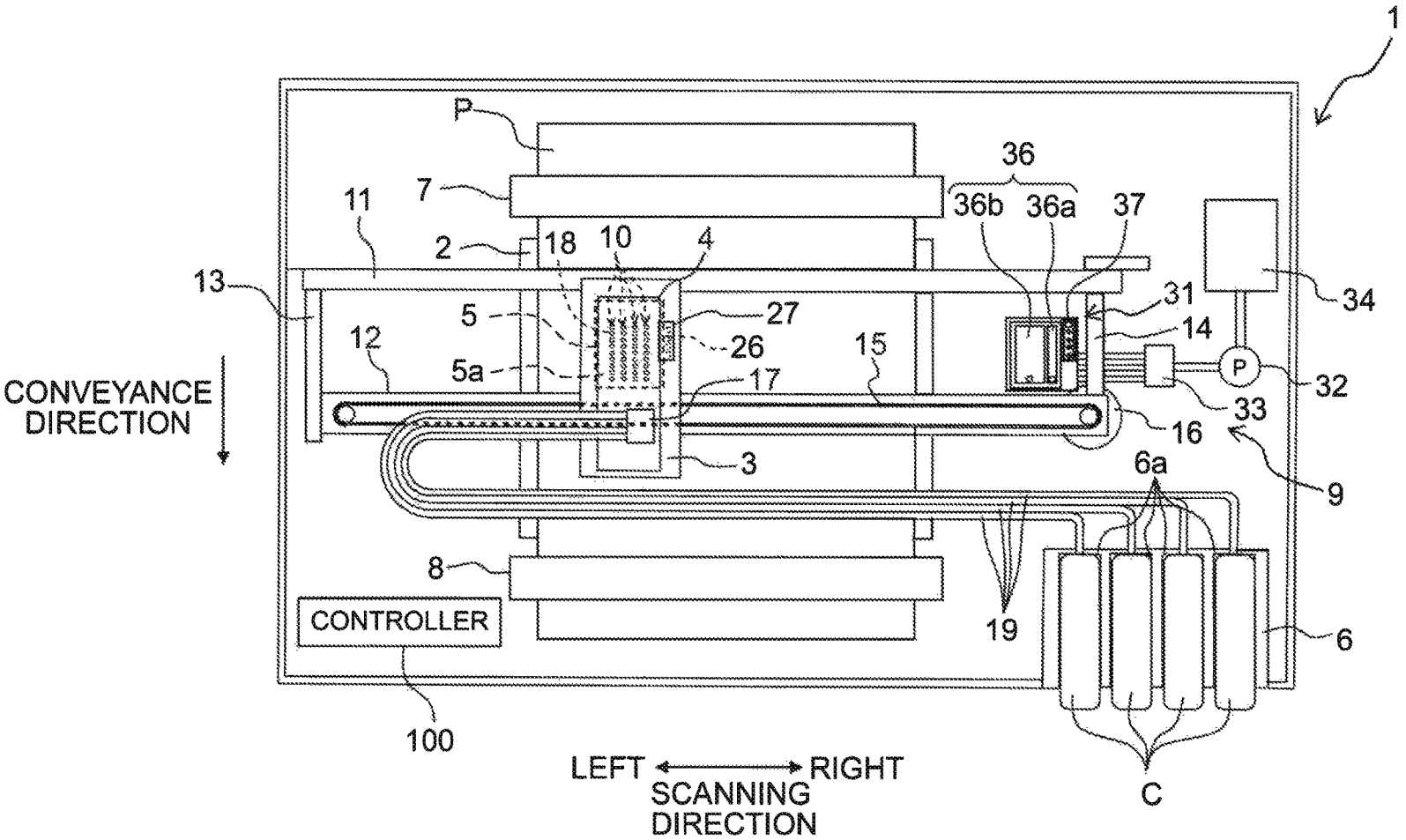
FIG. 1 is a view schematically depicting the configuration of a printer according to an embodiment of the present teaching.

As depicted in FIG. 1, a printer 1 is provided with a platen 2, a carriage 3, a sub tank 4, an ink-jet head 5, a cartridge holder 6, a conveying roller 7, a paper discharging roller 8, a maintenance unit 9, and the like. Further, the operation of the printer 1 is controlled by a controller 100.

The platen 2 supports a recording paper P (recording paper sheet P, or recording sheet P) as a recording medium which is conveyed in a conveyance direction (an example of a "third direction" in the present teaching) by the conveying roller 7 and the paper discharging roller 8. Further, two guide rails 11 and 12, which extend parallel to a scanning direction (an example of a "first direction" of the present teaching) orthogonal to the conveyance direction, are provided at a location above the platen 2. The two guide rails 11 and 12 are supported by frames 13 and 14, each at both end portions thereof in the scanning direction. The carriage 3 is supported by the two guide rails 11 and 12 such that the carriage 3 is movable in the scanning direction. An endless driving belt 15 is connected to the carriage 3; when the driving belt 15 is driven by a carriage motor 16, the carriage 3 is thereby moved in the scanning direction. Note that in the following description, the explanation will be given, while defining the right side and the left side in the scanning direction as those depicted in FIG. 1.

Figure 2A:
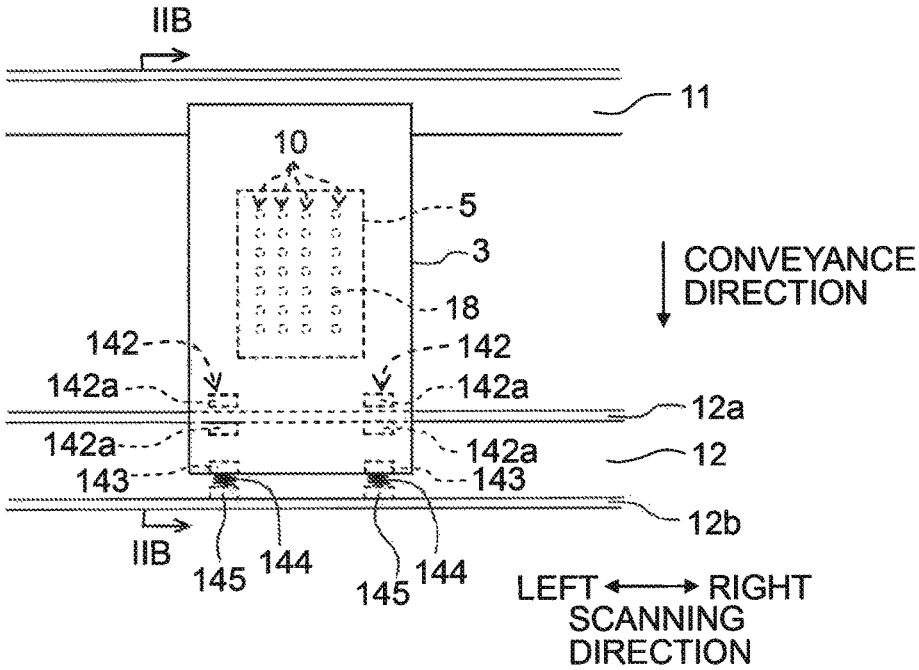
FIG. 2A is a plane view depicting a configuration in which a carriage is supported by a guide rail.
Figure 2B:
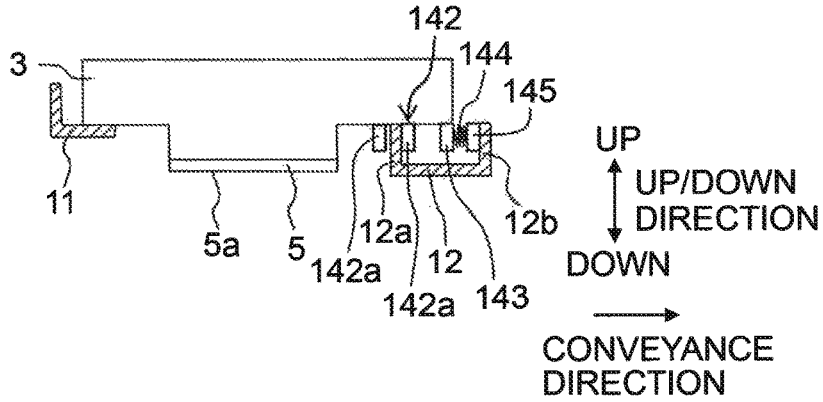
FIG. 2B is a cross-sectional view taken along a IIB-IIB line in FIG. 2A.

Here, an explanation will be given about a configuration for supporting the carriage 3, by the guide rails 11 and 12, to be movable in the scanning direction. As depicted in FIGS. 2A and 2B, in the guide rail 11, an end portion thereof, on the upstream side in the conveyance direction, of a metallic plate extending in the scanning direction is bent upwardly. Further, an end portion, of the carriage 3, on the upstream side in the conveyance direction is supported by the upper surface of the guide rail 11 from therebelow.

In the guide rail 12, both end portions thereof, in the conveyance direction, of a metallic plate extending in the scanning direction are bent upwardly. Further, these two end portions which are bent upwardly are leading portions 12*a* and 12*b* each of which is configured to guide the carriage 3 in the scanning direction.

Two sliding sections 142 are provided on a lower portion of the carriage 3. The two sliding sections 142 are arranged in the lower portion of the carriage 3, at locations, respectively, at each of which one of the sliding sections 142 faces the guiding portion 12*a*, with a spacing distance between the sliding sections 142 in the scanning direction. Further, each of the sliding sections 142 is constructed of two portions 142*a* which are located to sandwich the guiding portion 12*a* therebetween in the conveyance direction.

Spring attaching sections 143 are disposed in the lower portion of the carriage 3, respectively at downstream portions on the downstream side in the conveyance direction with respect to the respective sliding sections 142. Springs 144 are attached to the spring attaching sections 143, respectively; each of the springs 144 extends from one of the spring attaching sections 143 toward the downstream side in the conveyance direction. A sliding section 145 is attached to an end portion on the downstream side in the conveyance direction of each of the springs 144. The sliding section 145 is pressed against the guiding portion 12*b* of the guide rail 12 by the urging force of each of the springs 144. Further, by the reaction force of the spring 144 generated when each of the sliding sections 145 is pressed against the guiding portion 12*b*, the carriage 3 is urged toward the upstream side in the conveyance direction. With this, a portion 142*a*, among the two portions 142*a*, located on the downstream side in the conveyance direction of each of the sliding sections 142 is pressed against the guiding portion 12*a*. Furthermore, in a case that the carriage motor 16 is driven, the portion, of the carriage 3, which is supported by the guide rail 11 is slidably moved with respect to the guide rail 11, the sliding sections 142 and 145 are guided in the scanning direction by being slidably moved with respect to the guiding portions 12*a* and 12*b*, respectively, which in turn allows the carriage 3 to move in the scanning direction.

Further, in the present embodiment, there is looseness between the two portions 142*a* of each of the sliding portions 142 and the guiding portion 12*a*, due to the above-described configuration. With this, there is looseness between the carriage 3 and the guide rail 12. Here, the reason that the looseness is provided between the carriage 3 and the guide rail 12 is, for example, to adjust the posture of the carriage 3 such that the orientation of nozzle rows 10 (to be described later on) is parallel to the conveyance direction during the time of manufacturing the printer 1, and the like.

Figure 3:
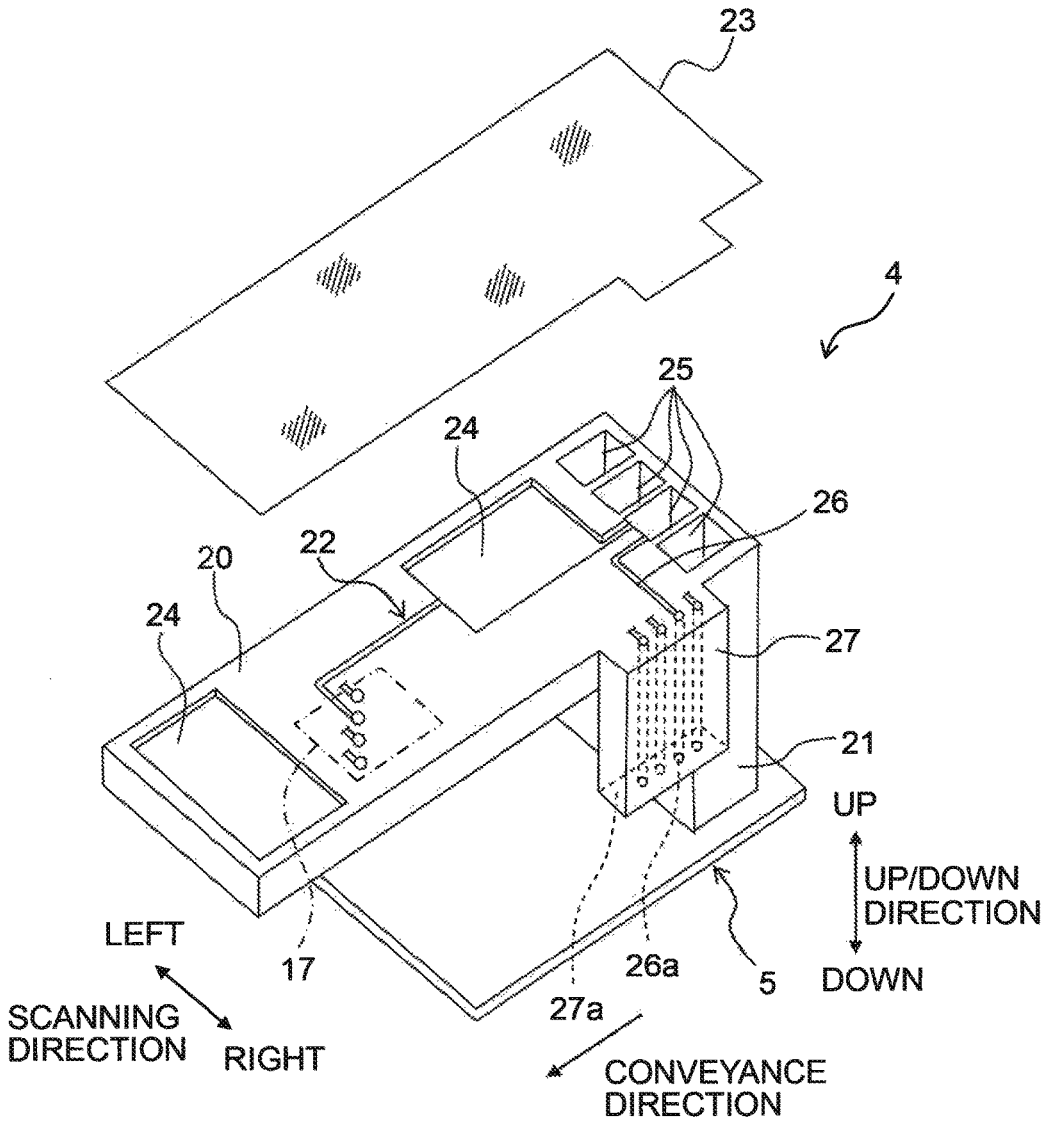
FIG. 3 is a perspective view depicting a schematic configuration of a sub tank and an inkjet head.
Figure 4:
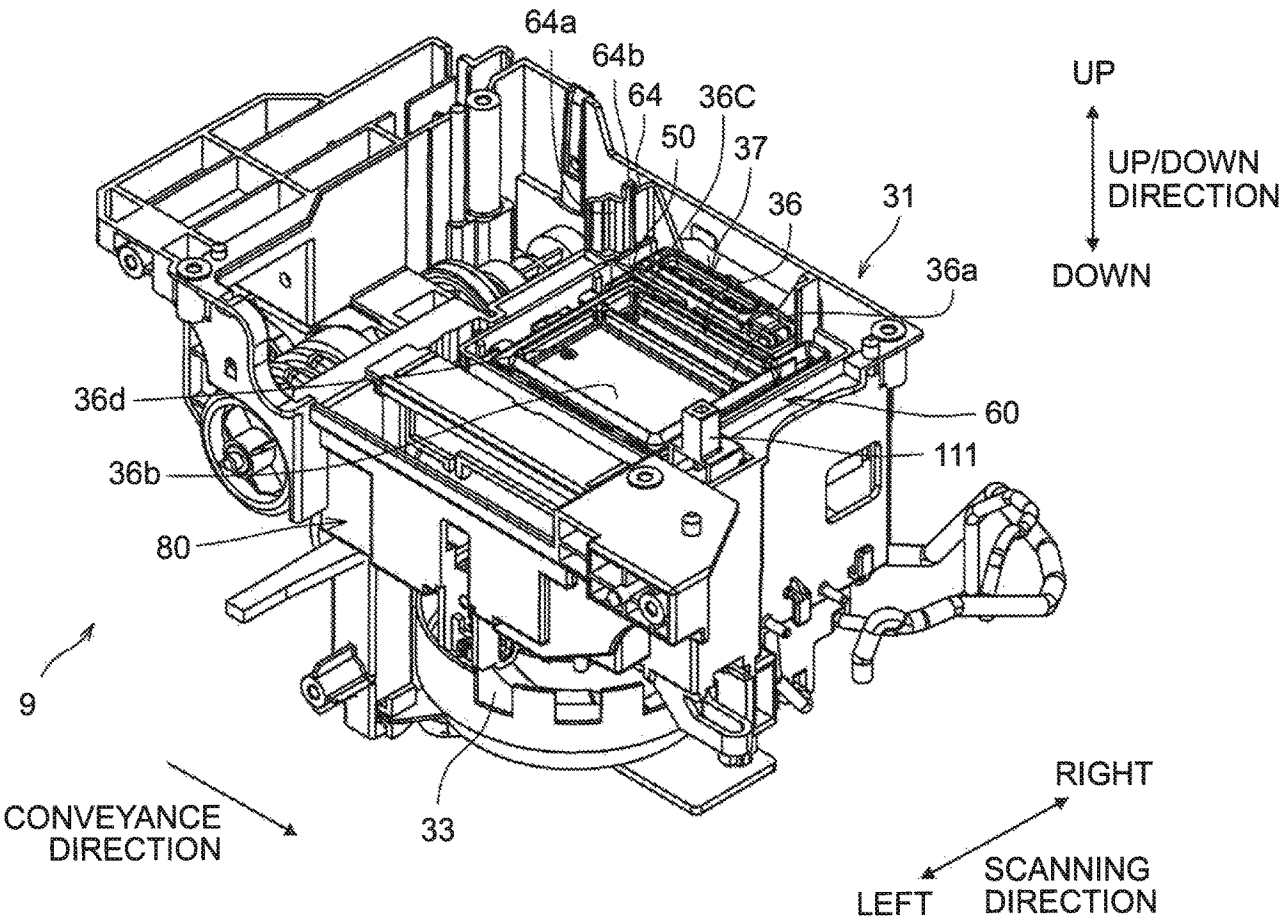
FIG. 4 is a perspective view of a capping unit.
Figure 5:
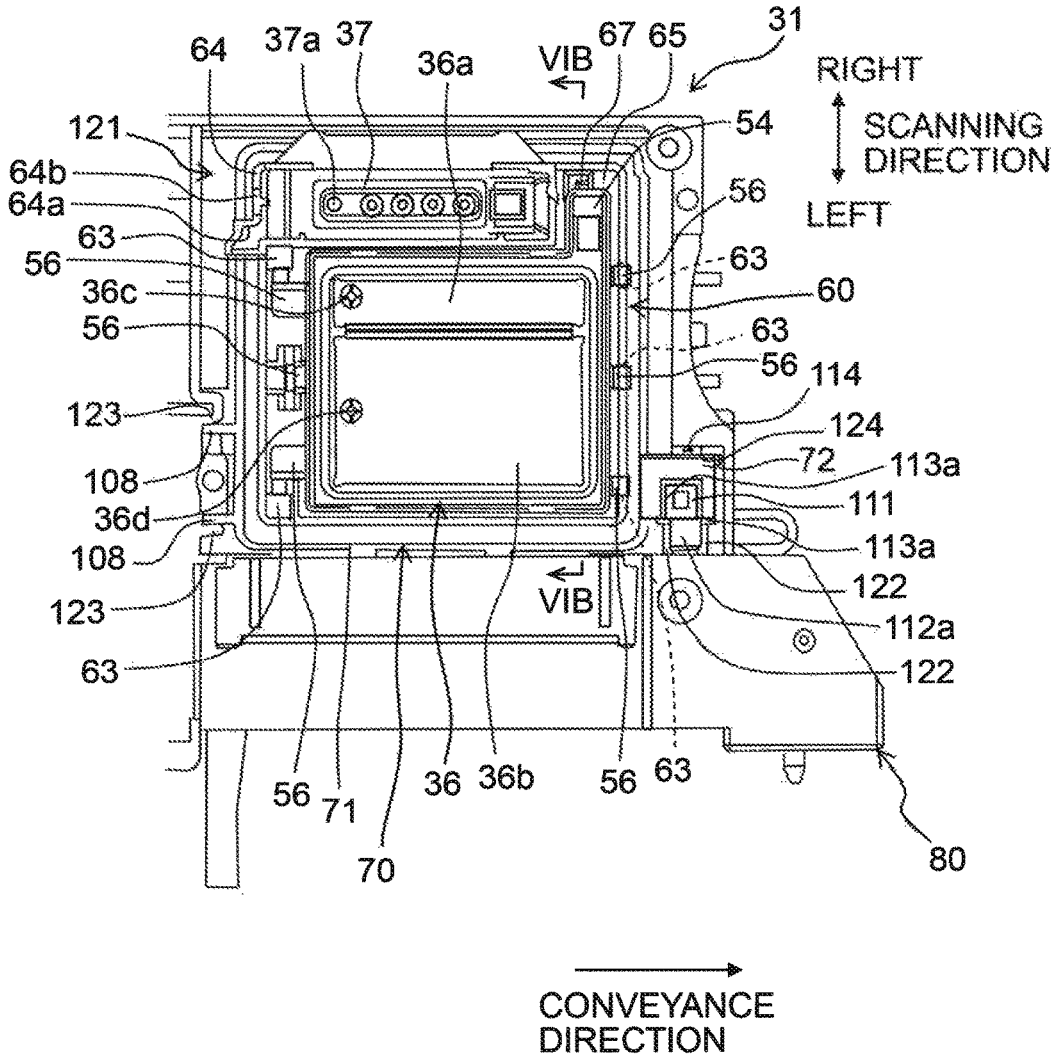
FIG. 5 is a plane view depicting portions or parts in the vicinity of a nozzle cap of the capping unit.

The sub tank 4 is mounted on the carriage 3. As depicted in FIGS. 1 and 3, a tube joint 17 is provided on the upper surface of the sub tank 4. The tube joint 17 is connected to the cartridge holder 6 via four tubes 19. Further, an exhaust unit 27 configured to exhaust air bubbles entered into a flow channel (channel) inside the sub tank 4 is provided on a rightward surface (a portion of the surface closer to the right end) of the sub tank 4. The configurations of the sub tank 4 and the exhaust unit 27 will be explained in detail later on.

The cartridge holder 6 is provide with four cartridge installing sections 6*a* which are arranged side by side in the scanning direction. Ink cartridges C are installed in the cartridge installing sections 6*a*, respectively. Black, yellow, cyan and magenta pigment inks are stored in this order in the four ink cartridges C, from an ink cartridge C which is included in the four ink cartridges C and which is installed in a rightmost ink cartridge installing section 6*a* among the four ink cartridge installing sections 6*a*. Further, the four color inks stored in the four ink cartridges C installed in the cartridge installing sections 6*a*, respectively, as described above are supplied to the sub tank 4 via the four ink tubes 19, respectively.

The ink-jet head 5 is attached to a lower portion of the sub stank 4. The ink-jet head 5 has an ink channel including a plurality of nozzles 18 formed in an ink jetting surface 5*a* which is the lower surface of the ink-jet head 5. The inks are supplied from the sub tank 4 to the ink-jet head 5, and the ink-jet head 5 jets or discharges the inks from the plurality of nozzles 18. The ink jetting surface 5*a* is formed with for nozzle rows 10. Each of the nozzle rows 10 is provided with a plurality of nozzles 18 aligned in the conveyance direction orthogonal to the scanning direction. The four nozzle rows 10 are arranged side by side in the scanning direction; the different color inks are jetted from the nozzle rows 10, respectively. Specifically, the four nozzle rows 10 are configured such that the magenta, cyan, yellow and black inks are jetted respectively therefrom in an order from the left side to the right side in the scanning direction.

The maintenance unit 9 is arranged at a maintenance position on the right side in the scanning direction relative to the platen 2 (on the right side with respect to the platen 2 in the scanning direction). The maintenance unit 9 is configured to execute a maintenance operation for maintaining and recovering (restoring) the jetting function of the ink-jet head 5. The detailed configuration of the maintenance unit 9 will be explained later on.

<Sub Tank>

As depicted in FIG. 3, the sub tank 4 includes a body portion 20 extending along a horizontal plane, and a connecting portion 21 extending in a vertically downward direction from an end portion, of the body portion 20, on the upstream side in the conveyance direction. The sub tank 4 is formed with four ink supply channels 22 which correspond to the four nozzle rows 10, respectively, and through each of which one of the four color inks flows. Note that in FIG. 3, only one of the four ink supply channels 22 is entirely depicted in the drawing, but a part of the remaining three ink supply channels 22 is omitted in the drawing, so as to simplify the illustration.

Each of the ink supply channels 22 has a damper chamber 24 formed in the body portion 20, and communicating channels 25 formed in the connecting portion 21. Flexible films 23 are adhered on both the upper and lower surfaces, respectively, of the body portion 20, and the channels including the damper chambers 24 formed in the body portion 20 are covered by the films 23. Each of the damper chambers 24 has such a shape that the cross section thereof is flat as compared with channel portions, of one of ink supply channels 22, which are connected to upstream side and downstream side portions of the damper chamber 24. Each of the damper chambers 24 absorbs the variation (fluctuation) in pressure of the ink flowing through one of the ink supply channels 22 with the deformation of the films 23. The connecting portion 21 of the sub tank 4 is connected to the ink-jet head 5. The inks flowing through the ink supply channels 22 are supplied to the ink-jet head 5 respectively from the communicating channels 25 formed in the connecting portion 21.

Further, as depicted in FIG. 3, the body portion 20 is also formed with four exhaust channels 26 connected to the four ink supply channels 22, respectively. Note that in FIG. 3, regarding the four exhaust channels 26, only one of the four exhaust channels 26 is entirely depicted in the drawing, but a part of the remaining three exhaust channels 26 is omitted in the drawing, so as to simplify the illustration.

Each of the exhaust channels 26 extends up to an exhaust unit 27 disposed on the rightward surface (a portion of the surface closer to the right end) of the sub tank 4. Further, a channel portion, of the exhaust channel 26, which is located in the inside of the exhaust unit 27 extends in the up/down direction (an example of a "second direction" of the present teaching), and a lower end portion of the channel portion is an opening 26*a*. With his, four openings 26*a* corresponding respectively to the four exhaust channels 26 are arranged side by side, in an exhaust surface 27*a* as the lower surface of the exhaust unit 27, so as to form a row in the conveyance direction. Further, a non-illustrated valve, configured to open/close each of the exhaust channels 26, is provided on the channel portion of each of the exhaust channels 26 extending in the up/down direction. Here, the up/down direction means a direction in which the gravity acts (gravity-acting direction).

<Maintenance Unit>

As depicted in FIG. 1, the maintenance unit 9 is provided with a capping unit 31, a suction pump 32, a switching device 33 and a waste liquid tank 34.

<Capping Unit>

As depicted in FIGS. 4, 5, 6A, 6B, 7A and 7B, the capping unit 31 is provided with a nozzle cap 36 (an example of a "cap" of the present teaching), an exhaust cap 37, a cap holder 50, a cap lift holder 60 (an example of a "first supporting member" of the present teaching), a cap lift base 70 (an example of a "second supporting member" of the present teaching), a base member 80 (an example of a "guide" of the present teaching), a slide cam 90, etc.

The nozzle cap 36 is constructed, for example, of a rubber material, and has a cap portion 36*a* and a cap portion 36*b* arranged on the left side in the scanning direction of the cap portion 36*a*, as depicted in FIGS. 1, 4, 5, 6A and 6B. In a case that the carriage 3 is moved to the maintenance position, the cap portion 36*a* faces a rightmost nozzle row 10 among the four nozzle rows 10, and the cap portion 36*b* faces three nozzle rows 10 included in the four nozzle rows 10 and arranged on the left side of the rightmost nozzle row 10. Further, the nozzle cap 36 has a lip portion 36*e*. The lip portion 36*e* is provided to erect from the upper surface of the nozzle cap 36, and to extend over (across) an outer circumferential portion of the nozzle cap 36 and over a portion between the cap portions 36*a* and 36*b*. With this, the nozzle cap 36 is comparted into the cap portion 36*a* and the cap portion 36*b* by the lip portion 36*e*. Further, suction ports 36*c* and 36*d* are provided on the cap portions 36*a* and 36*b*, respectively at upstream end portions in the conveyance direction thereof. The cap portions 36*a* and 36*b* are connected to the switching device 33 via tubes respectively at the suction ports 36*c* and 36*d*.

The exhaust cap 37 is constructed, for example, of a rubber material, and is arranged on the right side in the scanning direction of the nozzle cap 36, as depicted in FIGS. 1, 4, 5, 6A and 6B. In a case that the carriage 3 is moved to the maintenance position, the exhaust cap 37 faces the exhaust surface 27*a* of the exhaust unit 27. Further, a suction port 37*a* is provided on the exhaust cap 37 at an end portion on the upstream side in the conveyance direction of the exhaust cap 37. The exhaust cap 37 is connected to the switching device 33 via a tube at the suction port 37*a*. Furthermore, the exhaust cap 37 has a length in the conveyance direction shorter than that of the nozzle cap 36. Moreover, a position of an end portion, of the nozzle cap 36, on the upstream side in the conveyance direction is substantially same as that of the exhaust cap 37.

<Cap Holder>

As depicted in FIGS. 4, 5, 6A, 6B, 8A and 8B, the cap holder 50 has a shape which is substantially rectangular in a plane view and which is formed to have a recessed shape opening in the upper surface thereof. The nozzle cap 36 is accommodated in the recess-shaped cap holder 50 to be thereby held by the cap holder 50. To provide a more detailed explanation, the nozzle cap 36 is placed on an upper surface 51*a* of a bottom wall portion 51, of the recess-shaped cap holder 50, which forms a lower portion of the cap holder 50. Further, the entire circumferential portion of the nozzle cap 36 is surrounded by an edge wall portion 52, of the cap holder 50, projecting upwardly from an edge portion of the bottom wall portion 51 which expands (extends) to the outer side of the nozzle cap 36. Note that the edge wall portion 52 is not limited to or restricted by such an edge wall portion completely surrounding the entire circumferential portion of the nozzle cap 36; it is allowable that a portion of the edge wall portion 52 is cut out (the edge wall portion 52 has a cutout portion), etc. This is also applicable to an edge wall portion 62 of the cap lift holder 60 and an edge wall portion 102 of the cap lift base 70 which will be described later on. Further, an upper end portion of an inner side wall 52*a* located on the inner side of the edge wall portion 52 is formed as a tapered portion 52*a*1 tapered downwardly progressively toward the inner side thereof (tapered closer to the nozzle cap 36).

Furthermore, the bottom wall portion 51 has an end portion on the downstream side in the conveyance direction and on the right side in the scanning direction extends further rightwardly as compared with a remaining portion of the bottom wall portion 51 different from this rightwardly-extending end portion, and the rightwardly-extending end portion is located on the right side in the scanning direction relative to the nozzle cap 36 and on the downstream side in the conveyance direction relative to the exhaust cap 37. Moreover, a discharge port 54 via which any ink spilled from the nozzle cap 36 to the cap holder 50 is discharged is formed in this rightwardly-extending end portion of the bottom wall portion 51.

Further, a cylindrical portion 53 is provided on a portion, of the lower surface of the bottom wall portion 51, which overlaps with the discharge port 54 in the up/down direction. The cylindrical portion 53 is formed to have a substantially rectangular cylindrical shape extending downwardly from the bottom wall portion 51, and has an inner space 53*a* connecting with the discharge port 54. Furthermore, a right end portion of the cylindrical portion 53 is a projected portion 53*b* projected up to the lower side than the remaining portion of the cylindrical portion 53 different from the projected portion 53*b*.

Further, three projected portions 56*a*, which are arranged side by side in the conveyance direction, are provided on an end portion on the upstream side in the conveyance direction of the edge wall portion 52. Furthermore, three projected portions 56*b*, which are arranged side by side in the conveyance direction, are provided on an end portion on the downstream side in the conveyance direction of the edge wall portion 52.

<Cap Lift Holder>

As depicted in FIGS. 4, 5, 6A, 6B and 9A to 9C, the cap lift holder 60 has a shape which is substantially rectangular in a plane view and which is formed to have a recessed shape opening in the upper surface thereof. The cap holder 50 is accommodated in the recess-shaped cap lift holder 60 to be thereby held by the cap lift holder 60. More specifically, a coil spring 97 is disposed on a substantially central portion of an upper surface 61*a* of a bottom wall portion 61, of the recess-shaped cap lift holder 60, which forms a lower portion of the cap lift holder 60. The cap holder 50 is attached to an upper end portion of the coil spring 97, and is urged upwardly by the coil spring 97. Further, the entire circumferential portion of the cap holder 50 is surrounded by an edge wall portion 62, of the cap lift holder 60, projecting upwardly from an edge portion of the bottom wall portion 61 which expands or extends to the outer side of the cap holder 50.

Furthermore, three fitting portions 63*a* configured to fit with the three projected portions 56*a*, and three fitting portions 63*b* configured to fit with the three projected portions 56*b* are provided on the edge wall portion 62 of the cap lift holder 60. Moreover, the projected portions 56*a* fit with the fitting portions 63*a* respectively and the projected portions 56*b* fit with the fitting portions 63*b* respectively, to thereby connect the cap holder 50 and the cap lift holder 60 to each other. The fitting portions 63*a* and 63*b* each have a length in the up/down direction which is longer than that of one of the projected portions 56*a* and 56*b*; the projected portions 56*a* and 56*b* are movable in the up/down direction along the fitting portions 63*a* and 63*b*, respectively. Note, however, that a position of the projected portion 56*a* in a case that the projected portion 56*a* is moved within the fitting portion 63*a* and is located on the uppermost side thereof is located at a position above (on the upper side of) a position of the projected portion 56*b* in a case that the projected portion 56*b* is moved within the fitting portion 63*b* and is located on the uppermost side thereof. With this, in a state that the nozzle cap 63 is away from the ink jetting surface 5*a*, any upward movement of the cap holder 50 which is urged upwardly by the coil spring 97 is restricted by the fitting portions 63*a* and 63*b* at the projected portions 56*a* and 56*b*, thereby causing the nozzle cap 36 and the cap holder 50 to be inclined with respect to the conveyance direction to be located to be a lower side progressively toward the downstream side in the conveyance direction (see FIGS. 13A and 13B).

Further, there is hardly any gap (spacing distance) in the scanning direction between the projected portions 56*a*, 56*b* and the fitting portions 63*a*, 63*b*, respectively. With this, the projected portions 56*a*, 56*b* are fitted with respect to the fitting portions 63*a*, 63*b*, respectively, thereby regulating the relative movement of the cap holder 50 relative to the cap lift holder 60 in a horizontal plane. With this, the cap lift holder 60 is allowed to move integrally with the cap holder 50 and the nozzle cap 36 in a plane parallel to the horizontal plane (an example of a "plane parallel to the liquid jetting surface" of the present teaching).

Further, a projected portion 64 projecting upward is disposed on an upstream end portion in the conveyance direction of a right end portion of the edge wall portion 62. The projected portions 64 has a positioning surface 64*a* configured to be positioned with respect to the carriage 3 in a state that the carriage 3 is located at the maintenance position. Furthermore, a rib 64*b* (an example of a "contacting portion" of the present teaching) projecting further upwardly than the remaining portion of the projected portion 64 different from the rib 64*b*. With respect to this configuration, the carriage 3 has a recessed portion 3*b* which overlaps with the rib 64*b* in the up/down direction in the state that the carriage 3 is located at the maintenance position. Moreover, the rib 64*b* is accommodated in the recessed portion 3*b* in a capping state which will be described later on.

Further, an ink receiving portion 65 which is configured to receive an ink discharged from the discharge port 54 is disposed in the cap lift holder 60 at a portion thereof overlapping with the discharge port 54 in the up/down direction. The ink receiving portion 65 is formed to have a recessed shape opening in the upper surface thereof. Here, the recess-shaped ink-receiving portion 65 has a lower portion which is defined by a portion of the bottom wall portion 61. Furthermore, the ink receiving portion 65 is configured to be capable of receiving the ink on an upper surface 65*a* of the ink receiving portion 65. Moreover, the bottom wall portion 61 has a surrounding wall 65*b* which projects upwardly from a portion, of the bottom wall portion 61, forming the edge portion of the upper surface 65*a* of the ink receiving portion 65 and which surrounds the upper surface 65*a*. With this, the ink received by the upper surface 65*a* is prevented from flowing to the outside of the ink receiving portion 65. Further, a discharge port 67 which is open in the upper surface 65*a* is disposed on a right end portion of the ink receiving portion 65. Furthermore, a cylindrical portion 66 is disposed in a lower surface 61*c*, of the bottom wall portion 61, at a portion thereof overlapping with the discharge port 67. The cylindrical portion 66 is formed to have a substantially rectangular cylindrical shape extending downwardly, and has an inner space 66*a* connecting with the discharge port 67.

Moreover, four claw portions 68 projecting downwardly are disposed on the lower surface 61*c*, of the bottom wall portion 61 of the cap lift holder 60, at portions of the lower surface 61 located at the four corners thereof, respectively. Further, spring attaching portions 69 are disposed on the upper surface 61*a*, of the bottom wall portion 61, at locations overlapping in the up/down direction respectively with two claw portions 68 which are included in the four claw portions 68 and which are located on the left side. Coil springs 98 are attached to the spring attaching portions 69, respectively. Openings 59 are formed in the bottom wall portion 61 and the edge wall portion 62, each at a location across portions of the bottom wall portion 61 and the edge wall portion 62 which are located on the left side of one of the spring attaching portions 69. Each of the coil springs 98 is drawn to the outside of the cap lift holder 60 from one of the openings 59.

Further, the cap lift holder 60 is composed, for example, of a material having a relatively low hardness, such as polyacetal.

<Cap Lift Base>

As depicted in FIGS. 4, 5, 6A, 6B, 10B, 10B and 11A to 11C, the cap lift base 70 has a frame portion 71 and a locker erecting portion 72. The frame portion 71 is formed to have a recessed shape of which upper surface is opened; the cap lift holder 60 is accommodated by the frame portion 71 to be thereby held by the frame portion 71. To provide a more detailed explanation, the cap lift holder 60 is placed on an upper surface 101*a* of a bottom wall portion 101, of the recess-shaped frame portion 71, which forms a lower portion of the frame portion 71. Further, the entire circumferential portion of the cap lift holder 60 is surrounded by an edge wall portion 102, of the cap lift base 70, projecting upwardly from an edge portion of the bottom wall portion 101 which expands or extends to the outer side of the cap lift holder 60. Note that although any detailed explanation will be omitted, the exhaust cap 37 is also held by the cap lift base 70.

Furthermore, four through holes 103 to which the claw portions 68 are fit, respectively, are formed in the bottom wall portion 101 of the frame 71. Each of the through holes 103 extends in the scanning direction, and has a gap (clearance, spacing distance) in the scanning direction defined with respect to one of the claw portions 68. With this, the claws 68 are movable in the scanning direction in the through holes 103, respectively. Moreover, spring attaching portions 109 are disposed on the upper surface 101*a*, of the bottom wall portion 101, at locations in the vicinity of two through holes 103 which are included in the four though holes 103 and which are located on the left side. An end portion of each of the coil springs 98, on a side opposite to the other end portion thereof attached to the spring attaching portion 69, is attached to each of the spring attaching portions 109. The coil springs 98 are each a tension spring, and the cap lift holder 60 is urged leftwardly by the urging force of the coil springs 98.

Further, in the cap lift holder 60, the four claw portions 68 are movable within the four through holes 103, respectively, and the cap lift holder 60 is urged leftwardly by the coil springs 98. With this, the cap lift holder 60 is capable of moving parallel to and rotatable with respect to the frame portion 71 within the horizontal plane. Namely, the cap lift holder 60 is supported by the cap lift base 70 to be rotatable within the plane parallel to the horizontal plane. Here, the claw portions 68 are movable only in a range in which the through holes 103 are arranged.

Note that in the embodiment, the through holes 103 are formed in the cap lift base 70. It is allowable, however, that recessed portion to which the claw portions 68 are fit may be formed in the cap lift base 70, instead of the through holes 103. On the other hand, contrary to the aspect of the embodiment, it is also allowable that the upper surface of the frame portion 71 is formed with projected portions projecting upwardly, and that a lower surface of the bottom wall portion 61 of the cap lift holder 60 is formed with through holes or recessed portions which are opened in the lower surface.

Alternatively, it is allowable that claw portions are provided on the cap holder 50, that through holes or recessed portions fit with the claw portions are provided on the cap lift base 70, and that the claw portions are movable in the scanning direction within the through holes or recessed portions, thereby making the nozzle cap 36, the cap holder 50 and the cap lift holder 60 be supported by the cap lift base 70 to be rotatable in a plane parallel to the horizontal plane.

Further alternatively, in the embodiment, it is allowable that the claw portions 68 and the through holes 103 are not formed, and that the edge wall portion 62 of the cap lift holder 60 makes contact with the edge wall portion 102 of the cap lift base 70, thereby making the cap holder 50 and the cap lift holder 60 be supported by the cap lift base 70 to be rotatable in the plane parallel to the horizontal plane.

Further, an ink receiving portion 104 is disposed in the frame portion 71 at a portion thereof located below the cylindrical portion 66. The ink receiving portion 104 is formed to have a recessed shape of which upper portion is opened. A lower portion of the recess-shaped ink receiving portion 104 is defined by a portion of the bottom wall portion 101. Furthermore, the ink receiving portion 104 is configured to be capable of receiving the ink on an upper surface 104*a* of the ink receiving portion 104. Moreover, the bottom wall portion 101 has a surrounding wall 104*b* which projects upwardly from a portion, of the bottom wall portion 101, forming the edge portion of the upper surface 104*a* of the ink receiving portion 104 and which surrounds the upper surface 104*a*. With this, the ink received by the upper surface 104*a* is prevented from flowing to the outside of the ink receiving portion 104. Further, a discharge port 106 which is open in the upper surface 104*a* is disposed on a right end portion of the ink receiving portion 104. Furthermore, a cylindrical portion 105 is disposed in the lower surface 101*b*, of the bottom wall portion 101, at a portion thereof overlapping with the discharge port 106. The cylindrical portion 105 is formed to have a substantially rectangular cylindrical shape extending downwardly, and has an inner space 105*a* connecting with the discharge port 106.

Further, ribs 107 each of which projects downwardly and extends in the conveyance direction are disposed on the lower surface 101*b*, of the bottom wall portion 101 of the frame portion 71, in the vicinity of portions of the lower surface 101*b* overlapping respectively with the both end portion in the scanning direction of the nozzle cap 36. Two projected portions 107*a* extending outwardly in the scanning direction are provided respectively on outer end surfaces in the scanning direction of the ribs 107. These two projected portions 107*a* are arranged side by side in the scanning direction. Furthermore, two projected portions 108 which are arranged side by side in the scanning direction are provided on an end surface on the upstream side in the conveyance direction of the frame portion 71. Each of the projected portions 108 projects toward the upstream side in the conveyance direction and extends in the up/down direction.

The locker erecting portion 72 is formed to have a substantially rectangular parallelepiped shape elongated in the up/down direction. The locker erecting portion 72 is provided on the frame portion 71, in a left end portion of the outer circumferential surface, at a location thereof on the downstream side in the scanning direction. Further, the locker erecting portion 72 is provided with a carriage locker 111 (an example of a "carriage blocker" of the present teaching) which is provided erectedly (upstandingly) upwardly from the upper surface of the locker erecting portion 72. The carriage locker 111 is configured to prevent movement of the carriage 3 in the scanning direction, and is formed to have a rectangular parallelepiped shape. The carriage 3 is provided with a recessed portion 3*a* which overlaps with the carriage locker 111 in a state that the carriage 3 is located at the maintenance position. Further, the carriage locker 111 is accommodated in the recessed portion 3*a* in the capping state (to be described later on).

Furthermore, a boss 112*a* and a boss 112*b* each having a substantially cylindrical shape are disposed respectively on portions, of the locker erecting portion 72, in the vicinity of the upper end portion and the lower end portion; the bosses 112*a* and 112*b* erect leftwardly from the portions in the vicinity of the upper and lower end portions, respectively, of the locker erecting portion 72. The positions in the conveyance direction of the bosses 112*a* and 112*b* overlap with that of the carriage locker 111. Further, ribs 113*a* and ribs 113*b* erecting leftwardly are disposed on portions, of an end portion on the left side of the locker erecting portion 72, which are adjacent to the both sides in the conveyance direction of the bosses 112*a* and 112*b*, respectively. Here, the boss 112*a* and the ribs 113*a* are located above the projected portions 107*a*. On the other hand, the boss 112*b* and the ribs 113*b* are located slightly below the projected portions 107*a*. Further, a rib 114 erecting rightwardly and extending in the up/down direction is disposed on an end portion on the right side of the locker erecting portion 72.

Further, the cap lift base 70 is composed of a material having hardness higher than that of the cap lift holder 60, such as, for example, a mixed resin of polyphenylene ether, polystyrene and a glass fiber.

<Base Member>

As depicted in FIGS. 4, 5, 12A and 12B, the base member 80 has an accommodating portion 121 configured to accommodate the cap lift base 70 therein. The accommodating portion 121 supports the cap lift base 70 to be movable in the up/down direction. To provide more detailed explanation, the accommodating portion 121 is provided with two leading portions 122 which are arranged so as to sandwich the bosses 112*a* and 112*b* therebetween in the conveyance direction, and which extend in the up/down direction. The bosses 112*a* and 112*b* are guided (led) in the up/down direction by being slidably moved with respect to the guiding portions 122. Further, the accommodating portion 121 is provided with a guide surface 124 which makes contact with a forward end portion of the rib 114 and which extends in the up/down direction and the conveyance direction. The rib 114 is guided in the up/down direction along the guide surface 124. Further, the accommodating portion 121 is provided with two leading portions 123 which extend so as to sandwich the two projected portions 108 of the frame portion 71 in the scanning direction. With this, the projected portions 108 move slidably with respect to the guiding portions 123 to be guided in the up/down direction. Further, with these configurations, the cap lift base 70 is supported by the accommodating portion 121 to be movable in the up/down direction. Note that the accommodating portion 121 also have a configuration for supporting the cap lift base 70 to be movable in the up/down direction, in addition to these configurations as described above. However, any detailed explanation for such configuration will be omitted.

Furthermore, the movement in the conveyance direction of the two bosses 112*a* and 112*b* which are arranged side by side in the up/down direction is restricted by being sandwiched by the two leading portions 122 in the conveyance direction. With this, any shift or deviation of the boss 112*a* and boss 112*b* in the conveyance direction is restricted, thereby restricting the rotation of the cap lift base 70, including the locker erecting portion 72, with the scanning direction as the axis of the rotation.

Furthermore, forward end portions of the guiding portions 122 make contact with the ribs 113*a* and 113*b*. On the other hand, as described above, the forward end portion of the rib 114 makes contact with the guide surface 124. With this, the locker erecting portion 72 is sandwiched, in the scanning direction, by the guiding portions 122 and the guide surface 124 respectively at a portion of the locker erecting portion 72 corresponding to a height at which the rib 113*a* is arranged and at a portion of the locker erecting portion 72 corresponding to a height at which the rib 113*b* is arranged; this restricts the movement of the locker erecting portion 72 in the scanning direction. With this, any shift or deviation in the scanning direction of the portion of the locker erecting portion 72 corresponding to the height at which the rib 113*a* is arranged and the portion of the locker erecting portion 72 corresponding to the height at which the rib 113*b* is arranged is restricted, thereby regulating or restricting the rotation of the cap lift base 70, including the locker erecting portion 72 with the conveyance direction as the axis of the rotation.

Moreover, in the embodiment, the movement in the conveyance direction of the boss 112*a* and the boss 112*b* and the movement in the scanning direction of the locker erecting portion 72 are restricted by the leading portions 123 and the guide surface 124, and the movement in the scanning direction of the projected portions 108 is restricted by the leading portions 123, thereby restricting the rotation of the cap lift base 70 within the horizontal plane.

Here, the base member 80 is attached to the guide rails 11 and 12 and to the frame 14 on the right side, as depicted in FIG. 1. Note, however, that the member(s) to which the base member 80 is attached is (are) not limited to these members. For example, the base member 80 may be attached to only a part of the guide rails 11, 12 and frame 14. Alternatively, the base member 80 may be attached to a member configured to support the frame 14 from therebelow (for example, a member for accommodating the recording paper P, etc.).

Further, a through hole 125 is formed in the accommodating portion 121, at a portion thereof overlapping with the cylindrical portion 105 in the up/down direction. An ink foam 120 configured to absorb an ink is arranged at a position located below the base member 80 and overlapping at least with the through hole 125 in the up/down direction.

Here, in the embodiment, in such a case that the nozzle cap 36 is inclined, as will be described later on, the ink might spill or flow from the nozzle cap 36 to the cap holder 50, in some cases. In such a situation, the ink spilled to the cap holder 50 is received by the upper surface 51*a* of the bottom wall portion 51 of the cap holder 50, flows along a boundary line 55 between the bottom wall portion 55 and the edge wall portion 52 up to the discharge port 54, and is discharged downwardly from the discharge port 54. The ink discharged from the discharge port 54 is received by the upper surface 65*a* of the ink receiving portion 65 of the cap lift holder 60, flows through the discharge port 67 and the inner space 66*a* of the cylindrical portion 66, and is discharged downwardly. The ink discharged from the discharge port 67 and the cylindrical portion 66 is received by the upper surface 104*a* of the ink receiving portion 104 of the cap lift base 70, flows through the discharge port 106 and the inner space 105*a* of the cylindrical portion 105, and is discharged downwardly. Then, the ink discharged from the discharge port 106 and the inner space 105*a* of the cylindrical portion 105 passes through the through hole 125, reaches the ink foam 120 and is absorbed by the ink foam 120.

Further, the base member 80 has a portion(s) to which the switching device 33 and/or the suction pump 32 is/are attached, in addition to the accommodating portion 121 configured to support the cap lift base 70 to be movable in the up/down direction as described above.

<Slide Cam>

Figure 6A:
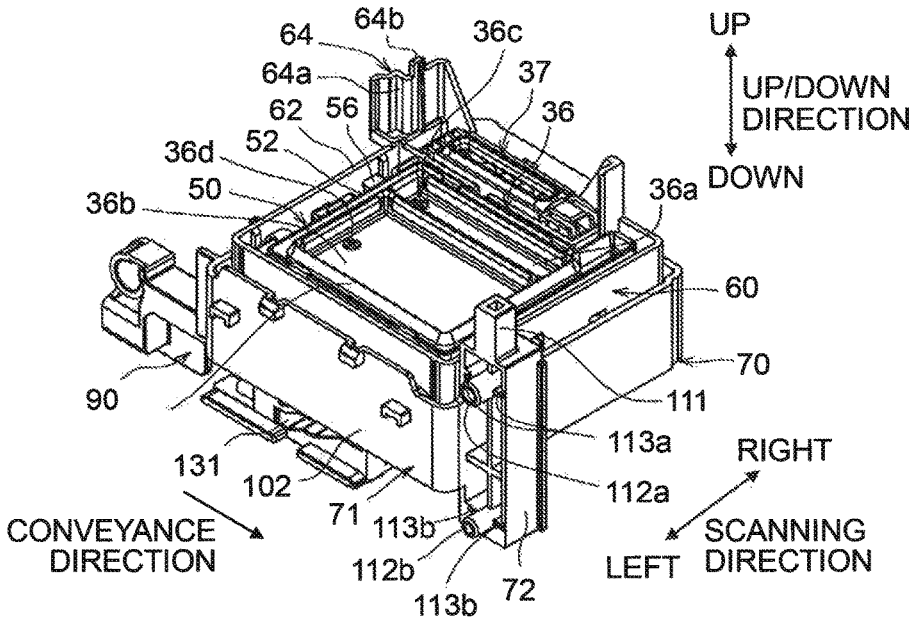
FIG. 6A is a perspective view corresponding to FIG. 4 and taking out and depicting a portion of the capping unit.
Figure 6B:
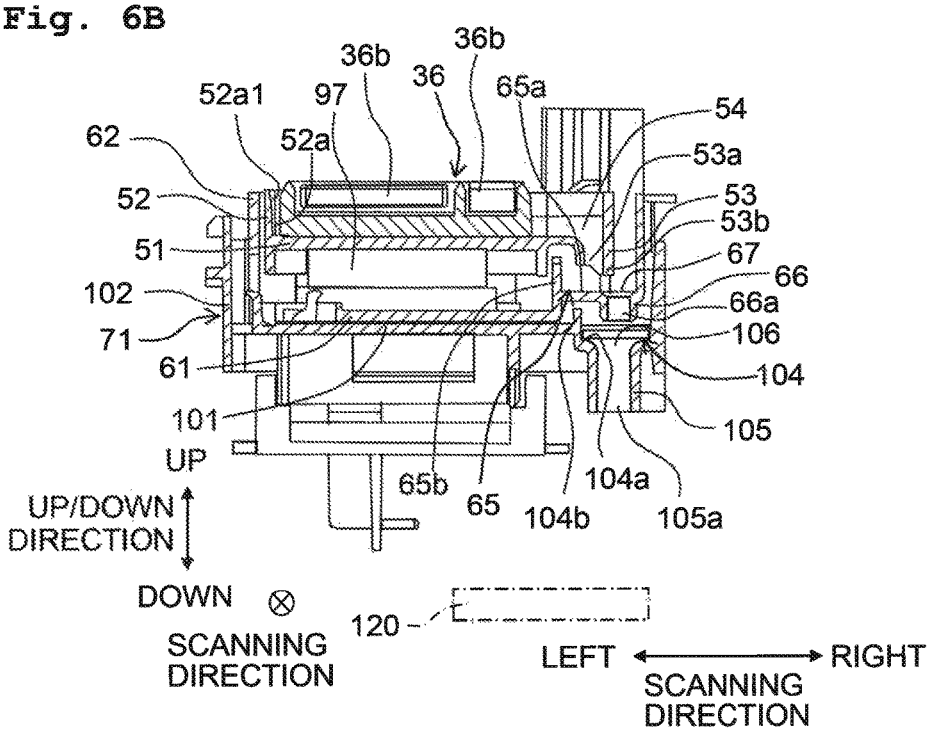
FIG. 6B is a cross-sectional view taken along a VIB-VIB line of FIG. 6A from which a base member is omitted.
Figure 7A:
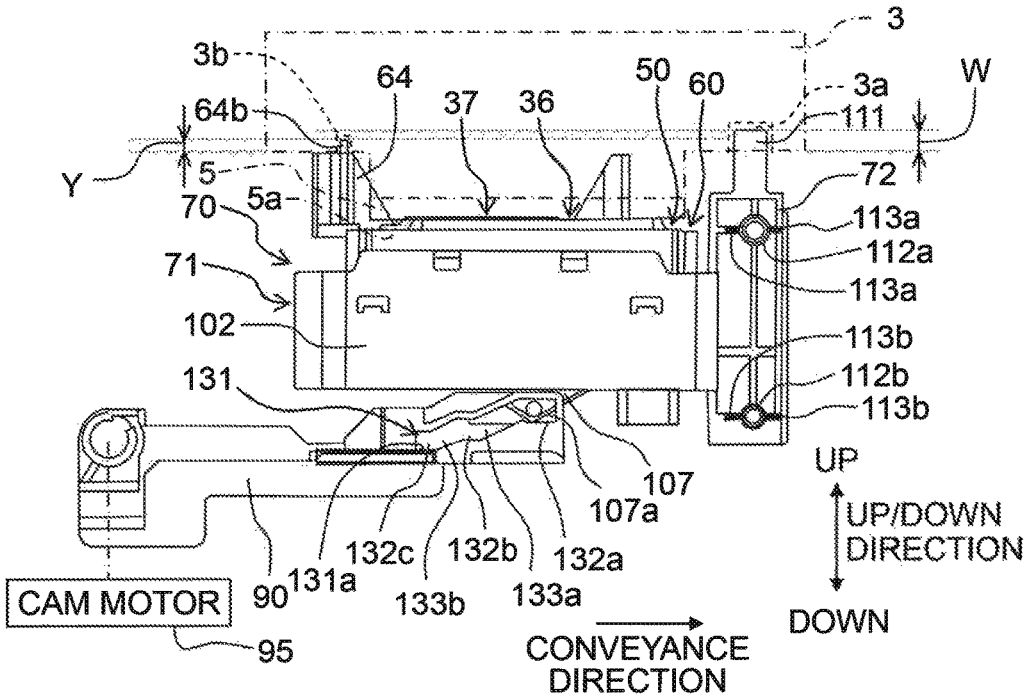
FIG. 7A is a side view seeing FIG. 6A from the left side.
Figure 7B:
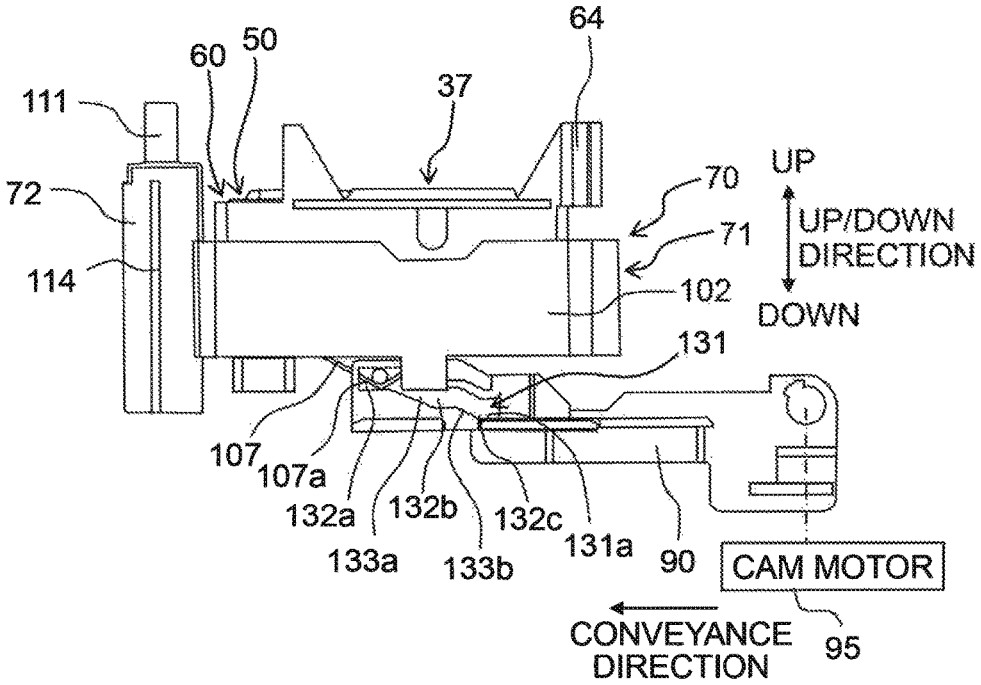
FIG. 7B is a side view seeing FIG. 6A from the right side.
Figure 8A:
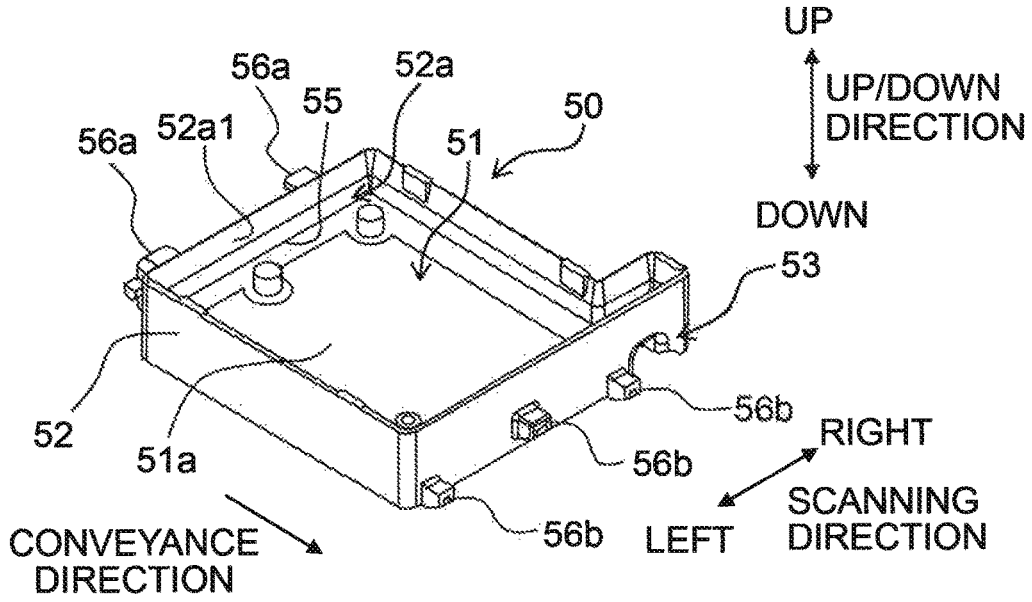
FIG. 8A is a perspective view of a cap holder, corresponding to FIG. 4.
Figure 8B:
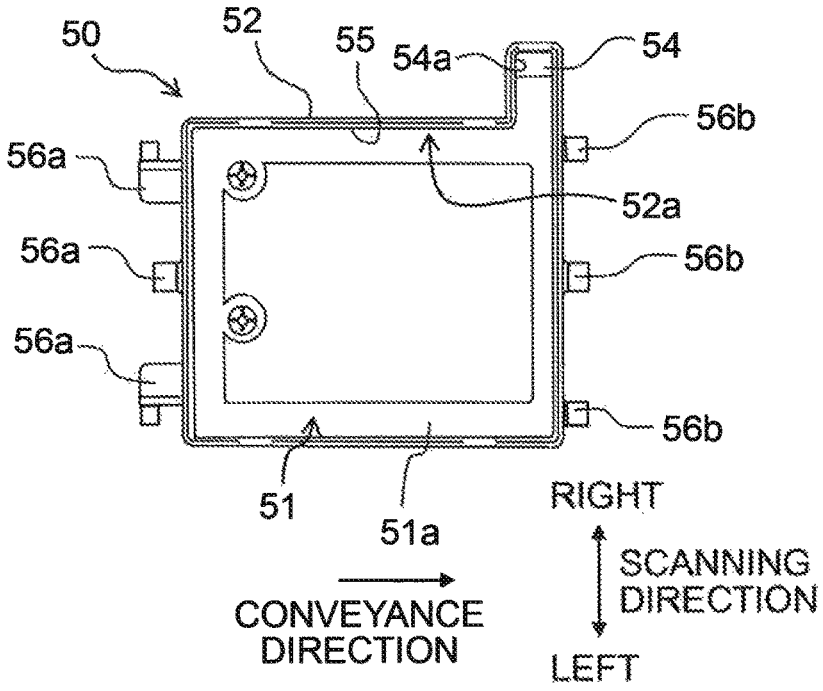
FIG. 8B is a plane view of the cap holder.

As depicted in FIGS. 6A, 7A and 7B, the slide cam 90 is a member extending along the conveyance direction, and is connected to a cam motor 95 (an example of a "power source" of the present teaching) via a non-illustrated gear, etc. In a case that the cam motor 95 is driven, the slide cam 90 reciprocates (moves in a reciprocating manner) in the conveyance direction. The slide cam 90 is supported by a plurality of ribs disposed on an inner bottom surface, of the base member 80, forming the accommodating portion 121, and the slide cam 90 is configured to be slidably movable with respect to the plurality of ribs. The slide cam 90 has two guide grooves 131 corresponding respectively to the two projected portions 107*a* of the cap lift base 70. In each of the guide grooves 131, one of the projected portions 107*a* corresponding thereto is inserted. Each of the guide grooves 131 has three parallel portions 132*a* to 132*c* and two inclined portions 133*a* and 133*b*.

The parallel portion 132*a* extends in parallel to the conveyance direction. The parallel portion 132*b* extends parallel to the conveyance direction, and is arranged on the upstream side in the conveyance direction and the lower side with respect to the parallel portion 132*a*. The parallel portion 132*c* extends parallel to the conveyance direction, and is arranged on the upstream side in the conveyance direction and the lower side with respect to the parallel portion 132*b*. The inclined portion 133*a* is arranged between the parallel portions 132*a* and 132*b* in the conveyance direction. The inclined portion 133*a* extends while being inclined with respect to the conveyance direction such that the inclined portion 133*a* is oriented upward progressively toward the downstream side in the conveyance direction, and connects the parallel portion 132*a* and the parallel portion 132*b*. The inclined portion 133*b* is arranged between the parallel portions 132*b* and 132*c* in the conveyance direction. The inclined portion 133*b* extends while being inclined with respect to the conveyance direction such that the inclined portion 133*b* is oriented upward progressively toward the downstream side in the conveyance direction, and connects the parallel portion 132*b* and the parallel portion 132*c*.

Then, in a state that the projected portions 107*a* are located in the parallel portions 132*a*, the nozzle cap 36, the exhaust cap 37, the cap holder 50, the cap lift holder 60 and the cap lift base 70 are located respectively at positions on the uppermost side in a movable range thereof. In a case that the nozzle cap 36 and the exhaust cap 37 are located at these positions in a state that the carriage 3 is moved to the maintenance position, the lip portion 36*e* of the nozzle cap 36 makes tight contact with the ink jetting surface 5*a*, thereby forming sealed spaces S1 and S2, each of which faces the nozzles 18 (see FIG. 14A), between the ink-jet head 5 and the cap portions 36*a* and 36*b*, respectively. With this, nozzles 18, among the plurality of nozzles 18, constructing the rightmost nozzle row 10 are covered by the cap portion 36, and nozzles 18, among the plurality of nozzles 18, constructing the three nozzle rows 10 on the left side are covered by the cap portion 36*b*. Here, for example, in a case that the ink-jet head 5 is provided with a cover portion which is arranged on the lower surface of the ink-jet head 5 so as to surround the ink jetting surface 5*a*, which projects downwardly beyond the ink jetting surface 5*a*, and which is configured to protect the plurality of nozzles 18, it is allowable that the lip portion 36*e* is configured to make contact with the lower surface of the cover portion. Further, the openings 26*a* of the exhaust channels 26 are covered by the exhaust cap 37. Note that in the embodiment, this state is an example of the "capping state" of the present teaching. Also note that in the following description, the position of the nozzle cap 36 in this state is referred to as a "capping position".

Further, in a case that the nozzle cap 36 is moved up to this position, the positioning surface 64*a* of the cap lift holder 60 makes contact with the carriage 3 from the scanning direction. With this, the cap lift holder 60 rotates with respect to the cap lift base 70 within the horizontal plane, depending on the inclination of the ink-jet head 5. As a result, the nozzle cap 36, which rotates together with the cap lift holder 60 within the horizontal plane is positioned with respect to the inclination of the ink-jet head 5. Further, in this state, the carriage locker 111 is accommodated by the recessed portion 3*a* of the carriage 3; and the rib 64*b* is accommodated in the recessed portion 3*b* of the carriage 3. With this, the carriage locker 111 becomes capable of making contact with an inner wall surface of the recessed portion 3*a* of the carriage 3. Further, in a case that the carriage 3 rotates, the rib 64*b* becomes capable of making contact with inner wall surfaces 3*b*1 and 3*b*2 of the recessed portion 3*b* of the carriage 3 Note that the position of the carriage locker 111 in this state corresponds to a "second position" of the present teaching, and that the position of the rib 64*b* in this state corresponds to a "fourth position" of the present teaching.

In the embodiment, the forward end portion of the rib 64*b* and the forward end portion of the carriage locker 111 are located at positions above the nozzle cap 36, as depicted in FIG. 7A. Further, the forward end portion of the rib 64*b* is located at a position below the forward end portion of the carriage locker 111. In contrast, the portion, of the carriage 3, forming the lower end portion of the recessed portion 3*a* and the portion, of the carriage 3, forming the lower end portion of the recessed portion 3*b* are located at a substantially same height. With this, in the capping state, a length Y in the up/down direction of an overlapping portion of the rib 64*b* overlapping with the recessed portion 3*b* (inner wall surfaces 3*b*1 and 3*b*2, as will be described later on) is made to be shorter than a length W in the up/down direction of an overlapping portion of the carriage locker 111 overlapping with the recessed portion 3*a*.

Figure 13A:
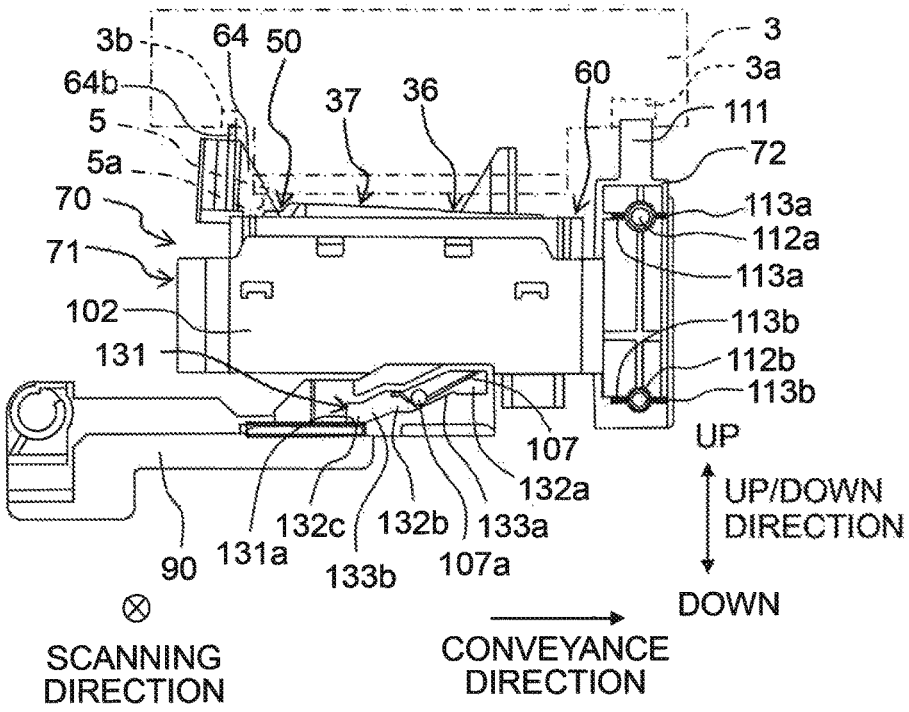
FIG. 13A is a view of the nozzle cap corresponding to FIG. 7A, in a state that the nozzle cap is separated away from an ink jetting surface.

In a case that the slide cam 90 is moved from this state toward the downstream side in the conveyance direction, each of the projected portions 107*a* slidably moves with respect to the inner wall surface 131*a* of one of the guide grooves 131, and the projected portions 107*a* are moved from the parallel portions 132*a* to the inclined portions 133*a*. With this, the nozzle cap 36, the exhaust cap 37, the cap holder 50, the cap lift holder 60 and the cap lift base 70 are descended (lowered), and the lip portion 36*e* of the nozzle cap 36 is separated away from the ink jetting surface 5*a*, as depicted in FIG. 13A. Further, in a case that the projections 107*a* are moved up to the parallel portions 132*b* of the guide grooves 131, the nozzle cap 36 is located at a predetermined height separated away from the ink jetting surface 5*a*. Note that in the following description, the position of the nozzle cap 36 in this situation is referred to as an "intermediate position".

Figure 13B:
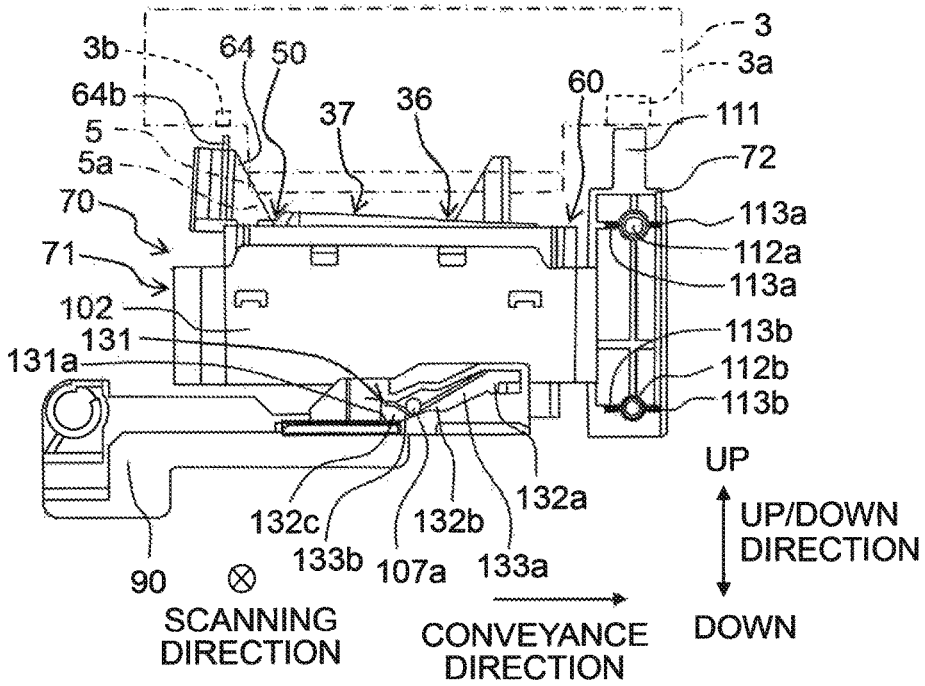
FIG. 13B is a view of the nozzle cap corresponding to FIG. 7A, in a state that the nozzle cap is separated away from the ink jetting surface farther than in the state depicted in FIG. 13A.

In a case that the slide cam 90 is further moved toward the downstream side in the conveyance direction, each of the projected portions 107*a* slidably moves with respect to the inner wall surface 131*a* of one of the guide grooves 131, and the projected portions 107*a* are moved from the parallel portions 132*b* to the inclined portions 133*b*. With this, the nozzle cap 36, the exhaust cap 37, the cap holder 50, the cap lift holder 60 and the cap lift base 70 are further descended (lowered), as depicted in FIG. 13B. Further, in a case that the projections 107*a* are moved up to the parallel portions 132*c* of the guide grooves 131, the nozzle cap 36 is located at the lowermost height within the movable range. Note that in the following description, the position of the nozzle cap 36 in this state is referred to as a "retracted position (withdrawn position)". Furthermore, in the embodiment, the position of the carriage locker 111 in this state corresponds to a "first position"; moreover, the position of the rib 64*b* in this state corresponds to a "third position" of the present teaching.

Further, in a case that the slide cam 90 is moved from this state toward the upstream side in the conveyance direction, in a reverse manner as described above, each of the projected portions 107*a* slidably moves with respect to the inner wall surface 131*a* of one of the guide grooves 131, and the projected portions 107*a* are moved in an order of (or in such a manner that the projected portions 107*a* move along in an order of) the parallel portions 132*c*, the inclined portions 133*b*, the parallel portions 132*b*, the inclined portions 133*a* and the parallel portions 132*a*, thereby raising the nozzle cap 36 from the retracted position up to the capping position, via the intermediate position.

Note that in the embodiment, a device constructed by combining the cap holder 50, the cap lift holder 60, the cap lift base 70, the base member 80, and the slide cam 90 together so as to raise and lower (ascend and descend) the nozzle cap 36 such that the nozzle cap 36 is switched between the capping state and the uncapping state corresponds to a "cap switching device" of the present teaching.

Here, in a case that the cap lift base 70 is ascended/descended, the carriage locker 111 is also ascended/descended. Further, the carriage locker 111 which is descending and is in a state that the carriage locker 111 is located above a predetermined first height which is between the intermediate position and the retracted position, the carriage locker 111 is accommodated in the inside of the recessed portion 3*a* of the carriage 3. In this state, the carriage locker 111 faces (is capable of making contact with), in the scanning direction, an inner wall surface 3*a*1 on the right side and an inner wall surface 3*a*2 on the left side in the recessed portion 3*a*, which in turn prevents the movement of the carriage 3 in the scanning direction, as will be described later on. On the other hand, as depicted in FIG. 13B, in a state that the nozzle cap 36 is located below the predetermined first height, the carriage locker 111 is located at a position below the recessed portion 3*a*, and does not make contact with the carriage 3.

Further, in the embodiment, the length Y in the up/down direction of the overlapping portion of the rib 64*b* overlapping with the recessed portion 3*b* in the capping state is shorter than the length W in the up/down direction of the overlapping portion of the carriage locker 111 overlapping with the recessed portion 3*a* in the capping state, as described above. Accordingly, in a state that the nozzle cap 36 is located further above a second height which is a height higher than the first height, the rib 64*b* is accommodated by the recessed portion 3*b*. In this state, the contact surfaces 64*b*1 and 64*b*2 which are the end surfaces on the right side and the left side of the rib 64*b* face, in the scanning direction, the inner wall surfaces 3*b*1 and 3*b*2 (corresponding to a "facing surface" of the present teaching) on the right side and the left side of the recessed portion 3*b*, respectively. Namely, the contact surfaces 64*b*1 and 64*b*2 of the rib 64*b* are capable of making contact with the inner wall surfaces 3*b*1 and 3*b*2 of the recessed portion 3*b*. Note that in the embodiment, the contact surface 64*b*1 corresponding to a "contact surface facing a side opposite to the platen in the scanning direction. On the other hand, in a state that the nozzle cap 36 is located at a position lower than the second height, the rib 64*b* is located lower than the recessed portion 3*b*, and the rib 64*b* does not make contact with the carriage 3.

Further, the printer 1 is in the capping state while being in a standby state in which no printing is executed. Then, in a case that a print instruction is inputted to the printer 1, at first, the nozzle cap 36, etc., are descended, as described above. Then, after the nozzle cap 36 is descended to a position lower than the first height and the carriage locker 111 does not overlap with the carriage 3 in the scanning direction, the carriage 3 is moved so as to start the printing. Note that in the embodiment, after the printing has been started in such a manner, the nozzle cap 36 is descended further to (so as arrive at) the retraction position. In this situation, as described above, in a case that the nozzle cap 36 is descended to reach the second height, the rib 64*b* is moved to a location below the recessed portion 3*b*; afterwards, in a case that the nozzle cap 36 is descended to reach the first height, the carriage locker 111 is moved to a location below the recessed portion 3*a*.

In contrary to the above-described aspect, there is presumed such a case that the forward end portion of the rib 64*b* is located above the forward end portion of the carriage locker 111, and that the rib 64*b* is moved to the location below the recessed portion 3*b* after the carriage locker 111 has moved to the location below the recessed portion 3*a*. The cap lift holder 60, which is configured to be integrally movable with the nozzle cap 36 is more likely to rotate with the scanning direction as the axis of rotation, as compared with the cap lift base 70 which does not move integrally with the nozzle cap 36 within the horizontal plane and of which rotation with the scanning direction as the axis of rotation is restricted by the base member 80. Accordingly, the rib 64*b* provided on the cap lift holder 60 is more likely to incline as compared with the carriage locker 111 provided on the cap lift base 70.

If the rib 64*b* does not incline, then in a case that the nozzle cap 36 is descended in a predetermined descending amount, the rib 64*b* is moved to the location below (to the lower side of) the recessed portion 3*b*. However, in a case that the rib 64*b* inclines, depending on the manner in which the rib 64*b* inclines, the forward end portion of the rib 64*b* is located inside the recessed portion 3*b* even when the nozzle cap 36 is descended in the predetermined descending amount, in some cases. Accordingly, considering any inclination of the rib 64*b*, it is necessary to start the movement of the carriage 3 after having the nozzle cap 36 to be descended in an amount greater than the predetermined descending amount. Namely, when considering the inclination of the rib 64*b*, it is necessary that the movement of the carriage 3 is started after waiting until the nozzle cap 36 is descended in a descending amount set to be greater than the predetermined descending amount by which the nozzle cap 36 is descended to the location below the recessed portion 3*b* provided that the rib 64*b* does not incline. As a result, a time after the print instruction is inputted and until the carriage 3 is allowed to be moved so as to start the printing becomes long.

In view of the situation as described above, the present embodiment makes the carriage locker 111 to move to the location below the recessed portion 3*a* after the rib 64*b* has moved to the location below the recessed portion 3*b*. As describe above, the rotation of the cap lift base 70 with the scanning direction as the axis of rotation is restricted by the base member 80. Accordingly, the carriage locker 111 provided on the cap lift base 80 is less likely to incline. Therefore, there is no need to make the descending amount of the nozzle cap 36 before stating the movement of the carriage 3 to be great in consideration of the inclination of the carriage locker 111. With this, the time after the print instruction is inputted and until the movement of the carriage 3 is started so as to perform the printing can be made short.

Figure 14A:
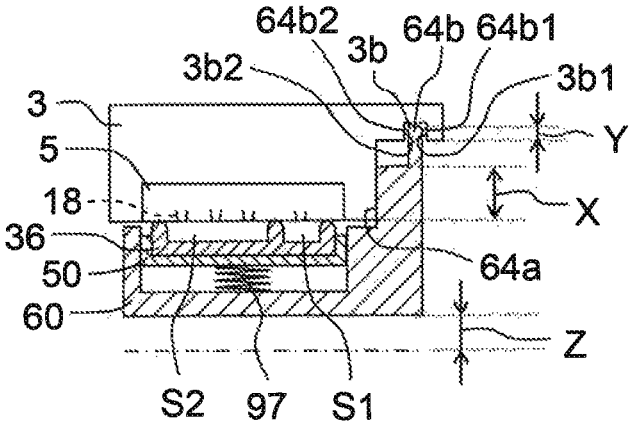
FIG. 14A is a schematic view for explaining the positional relationship among the carriage, the nozzle cap and the cap lift holder in a capping state and seen from the downstream side in a conveyance direction.

Further, in the embodiment, there is a magnitude relationship: $Y<Z<X$, as depicted in FIG. 14A, among a length X of an overlapping portion of the carriage 3 overlapping with the positioning surface 64*a* (an example of a "first length" of the present teaching) in the capping state, the length Y in the up/down direction of the overlapping portion of the contact surface 64*b*1 of the rib 64*b* overlapping with the inner wall surface 3*b*1 of the recessed portion 3*b* (an example of a "second length" of the present teaching) in the capping state, and a moving amount Z in the up/down direction of the cap lift holder 60 in a case that the nozzle cap 36 is moved from the retracted position up to the capping position (an example of a "third length" of the present teaching). There, a dot-dash line depicted in FIG. 14A indicates the position of the lower end portion of the cap lift holder 60 in a state that the nozzle cap 36 is located at the retracted position.

Figure 14B:
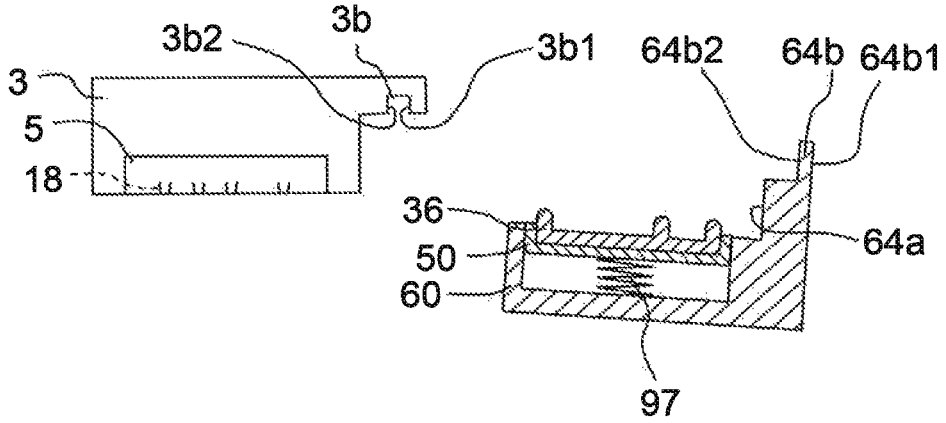
FIG. 14B is a view corresponding to FIG. 14A, depicting a state that the carriage is separated away from a maintenance position.
Figure 14C:
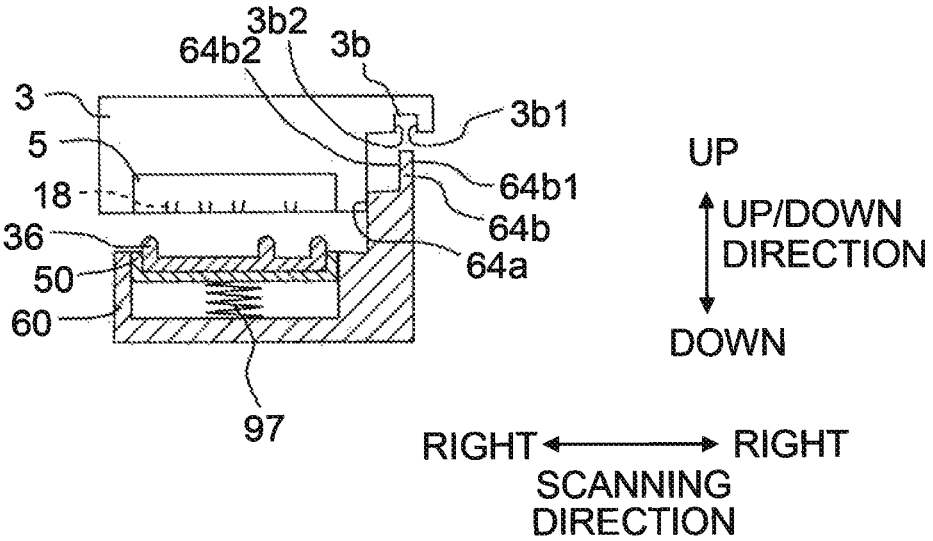
FIG. 14C is a view corresponding to FIG. 14A, depicting a state that the carriage is moving up to the maintenance position.

In a state that the carriage 3 is located on the left side with respect to the maintenance position during, for example, printing, etc., the nozzle cap 36, the cap holder 50 and the cap lift holder 60 are inclined in the scanning direction with respect to the posture thereof in the capping state in some cases, as depicted in FIG. 14B. In the embodiment, the magnitude relationship of $Z<X$ holds; thus, when the carriage 3 is moved to the maintenance position, the carriage 3 makes contact with the positioning surface 64*a* to thereby position the carriage 3 and the cap lift holder 60 with each other, as depicted in FIG. 14C. Further, since the magnitude relationship of $Y<X$ holds, the rib 64*b* is located at the position below the recessed portion 3*b* in this state. Furthermore, in a case that the nozzle cap 36, the cap holder 50 and the cap lift holder 60 are ascended from this state, then the rib 64*b* is accommodated in the recessed portion 3*b*, as depicted in FIG. 14A. Namely, in the embodiment, after the carriage 3 and the cap lift holder 60 are positioned with each other, the rib 64*b* is accommodated in the recessed portion 3*b*. With this, in a case of moving the cap from the retracted position to the capping position, the rib 64*b* does not interfere, for example, with a portion, of the carriage 3, which constructs a wall of the recessed portion 3*b*, etc. Note that the magnitude relationship $Y<Z$ is made to hold for the purpose of allowing the rib 64*b* to be accommodated in the recessed portion 3*b* in the capping state and for locating the rib 64*b* at a position below the recessed portion 3*b* in the uncapping state.

Figure 15A:
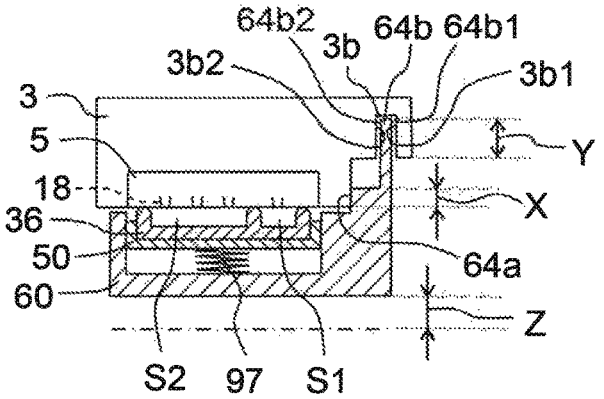
FIG. 15A is a view of a comparative example, corresponding to FIG. 14A.
Figure 15B:
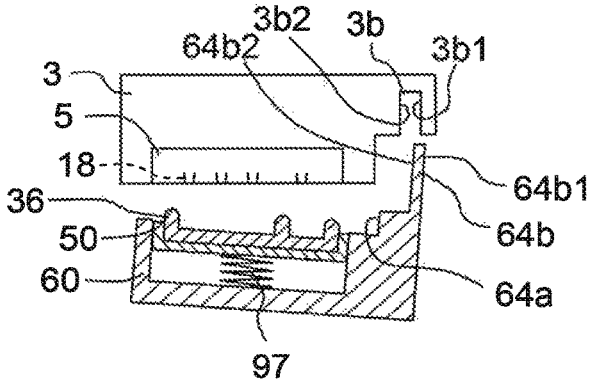
FIG. 15B is a view corresponding to FIG. 15A, depicting a state that the carriage is moving up to the maintenance position in the comparative example.

In contrast, there is presumed such a case with a magnitude relationship $Y>X$ holds as depicted in FIG. 15A, unlike the embodiment. In such a case, as depicted in FIG. 15B, even when the carriage 3 is moved to the maintenance position, the carriage 3 does not make contact with the positioning surface 64*a*. Accordingly, in this presumed case, in a case that the nozzle cap 36, the cap holder 50 and the cap lift holder 60 are inclined in the scanning direction as compared with the postures thereof in the capping state, the nozzle cap 36, the cap holder 50 and the cap lift holder 60 are remained to be inclined even if the carriage 3 is moved to the maintenance position.

Figure 15C:
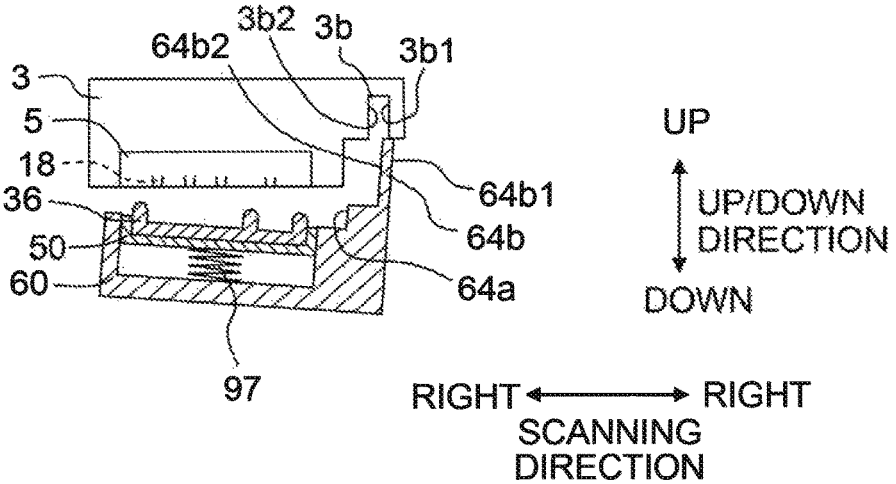
FIG. 15C is view corresponding to FIG. 15A, depicting a state that the nozzle cap, etc., are lifted (moved upward) from the state depicted in FIG. 15B.

Then, afterwards, in a case that the nozzle cap 36, the cap holder 50 and the cap lift holder 60 are ascended, the rib 64*b* reaches the recessed portion 3*b* before the positioning surface 64*a* makes contact with the carriage 3. In this situation, if the nozzle cap 36, the cap holder 50 and the cap lift holder 60 are inclined, there is such a fear that the rib 64*b* might interfere, for example, a portion, of the carriage 3, which constructs the wall of the recessed portion 3*b*, etc., as depicted in FIG. 15C.

Further, in the embodiment, a spacing distance K1 in the scanning direction between the contact surface 64*b*1 of the rib 64*b* and the inner wall surface 3*b*1 of the recessed portion 3*b*, and a spacing distance K2 in the scanning direction between the contact surface 64*b*2 of the rib 64*b* and the inner wall surface 3*b*2 of the recessed portion 3*b* are smaller than a spacing distance J1 in the scanning direction between a left end portion of the lip portion 36*e* and a leftmost nozzle row 10, a spacing distance J2 in the scanning direction between a right end portion of the lip portion 36*e* and a rightmost nozzle row 10, and spacing distances J3 and J4 between a portion, of the lip portion 36*e*, between the cap portions 36*a*, 36*b* and the rightmost nozzle row 10 and a nozzle row 10 second from the right (second-rightmost nozzle row 10), respectively (K1, K2<J1, J2, J3, J4). Here, the spacing distance K1 may be same as or different from the spacing distance K2. Further, the spacing distances J1 to J4 may be same as one another at least partially, or may be different from one another. With this, the spacing distances K1 and K2 are smaller than the spacing distance between the lip portion 36*e* and a nozzle row 10 which is closest to the lip portion 36*e* in the scanning direction (the smallest spacing distance among the spacing distances J1 to J4). Note that in the embodiment, the spacing distances are defined between the contact surface 64*b*1 and the inner wall surface 3*b*1 and between the contact surface 64*b*2 and the inner wall surface 3*b*2 so as to prevent the rib 64*b* from interfering with the portion, of the carriage 3, constructing the wall of the recessed portion 3*b* in a case that the nozzle cap 36 is ascended to be moved to the capping position. Note that in FIG. 16 and in FIGS. 17A, 17B and 18A, 18B which will be described later on, portions or parts different from the cap holder 50 and the carriage locker 111 of the cap lift base 70 are omitted so that the drawings can be easily understood.

In the printer 1, any large external force is applied to the printer 1 during transportation, etc., in some cases. For example, the posture of a box storing the printer 1 therein is changed during the transportation such that the posture of the printer 1 is changed from a printing posture (posture assumed by the printer 1 during printing) to such a posture that the scanning direction is parallel to the up/down direction), which in turn causes a large external force in the scanning direction to be applied to the printer 1.

Figure 17B:
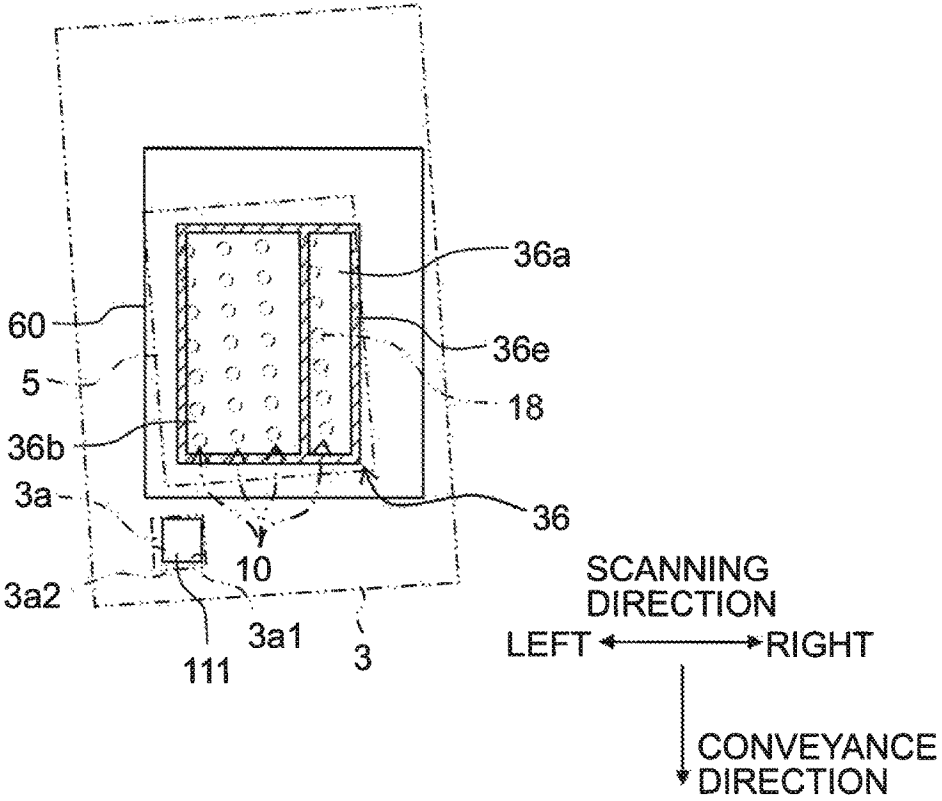
FIG. 17B is a view depicting a state after the state depicted in FIG. 17A, provided that no rib is present.
Figure 17A:
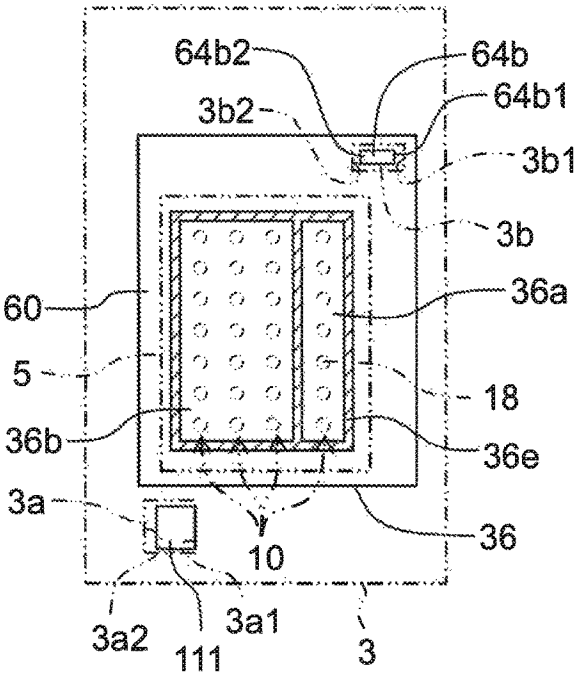
FIG. 17A is a state corresponding to FIG. 16, depicting a state that the movement of the carriage is started to be prevented by a carriage locker.

In a case that an external force toward the left side in the scanning direction is applied to the printer 1, the external force toward the left side in the scanning direction is also applied to the carriage 3 and the carriage 3 attempts to move toward the left side in the scanning direction. However, as depicted in FIG. 17A, the carriage locker 111 makes contact with the inner wall surface 3*a*1 on the right side of the recessed portion 3*a*, thereby preventing the movement of the carriage 3. Note that in this situation, however, the carriage 3 is prevented from moving (toward the left side in the scanning direction) only due to the contact of the inner wall surface 3*a*1 of the recessed portion 3*a*, provided on a left front end portion of the carriage 3, with respect to the carriage locker 111. Further, as described above, there is looseness between the carriage 3 and the guide rail 12. Accordingly, the carriage 3 of which movement is prevented by the carriage locker 111 rotates within the horizontal plane counterclockwise, with the carriage locker 111 as the supporting point.

Provided that the magnitude of the external force applied to the carriage 3 is great in a case that the carriage 3 rotates with the carriage locker 111 as the supporting point, the carriage 3 and the nozzle cap 36 move relative to each other within the horizontal plane, against the friction force between the ink jetting surface 5*a* and the lip portion 36*e*. In this situation, there is presumed such a case that the rib 64*b* is not provided, unlike the present embodiment. Then, as depicted in FIG. 17B, there is such a fear that the carriage 3 (ink-jet head 5) and the nozzle cap 36 might move relative to each other greatly in the scanning direction, and the lip portion 36*e* might make contact with the nozzles 18. Specifically, the left end portion of the lip portion 36*e* makes contact with nozzles 18 forming the leftmost nozzle row 10, and the portion, of the lip portion 36*e*, between the cap portions 36*a* and 36*b* makes contact with nozzles 18 forming the rightmost nozzle row 10.

Further, in such a case that the ink-jet head 5 is long in the conveyance direction, then when the carriage 3 rotates, a portion of the ink-jet head 5 located farther from the carriage locker 111 in the conveyance direction shifts or deviates relative to the nozzle cap 36 to a greater extent than another portion of the ink-jet head 5 located closer to the carriage locker 111 in the conveyance direction. Consequently, in such a case, there is a high possibility that the lip portion 36*e* might make contact with nozzles 18 located farther from the carriage locker 111.

Furthermore, provided that the external force applied to the carriage 3 is great in a case that the carriage 3 rotates, then in some cases, the carriage 3 might be deformed momentarily and/or a forward end portion of the guiding portion 12*a* of the guide rail 12 might be deformed momentarily due to the force applied by the sliding sections 142. Moreover, in such a case, the carriage 3 and the nozzle cap 36 move relative to each other in the scanning direction particularly to a great extent, due to which the lip portion 36*e* is likely to make contact with the nozzles 18.

In such a case, for the purpose of preventing the lip portion 36*e* from making contact with the nozzles 18, there is conceived for example such a configuration wherein the spacing distance in the scanning direction between the rightmost nozzle row 10 and the second-rightmost nozzle row 10 is made to be great and/or the nozzle cap 36 is made to be large-sized, so as to increase the spacing distances J1 to J4 each between the lip portion 36*e* and one of the respective nozzle rows 10. In this case, however, the ink jetting surface 5*a* with which the nozzle cap 36 is configured to make tight contact becomes unnecessarily large. Further, in a case that the nozzle cap 36 is made to be large, the volumes of the sealed spaces 51 and S2 becomes large, which in turn increases the amount of the ink, to be jetted from the ink-jet head 5 when a suction purge (to be described later on) is executed, to be unnecessarily large.

Figure 18B:
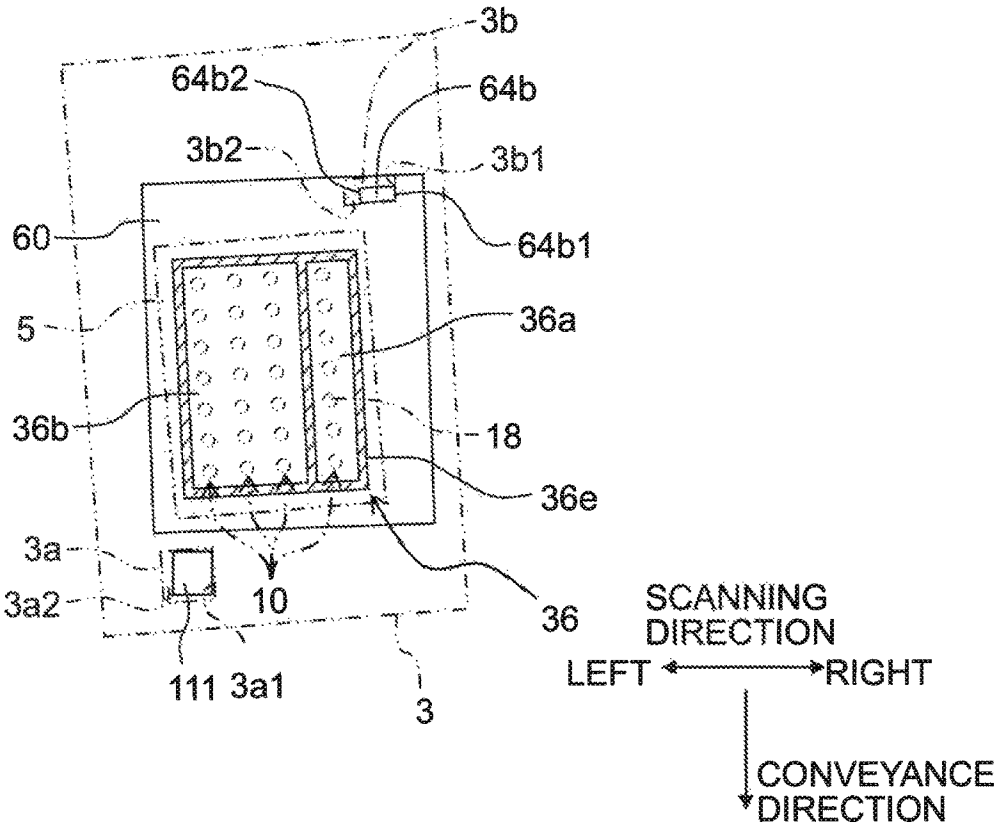
FIG. 18B is a view depicting a state after the state depicted in FIG. 18B.
Figure 18A:
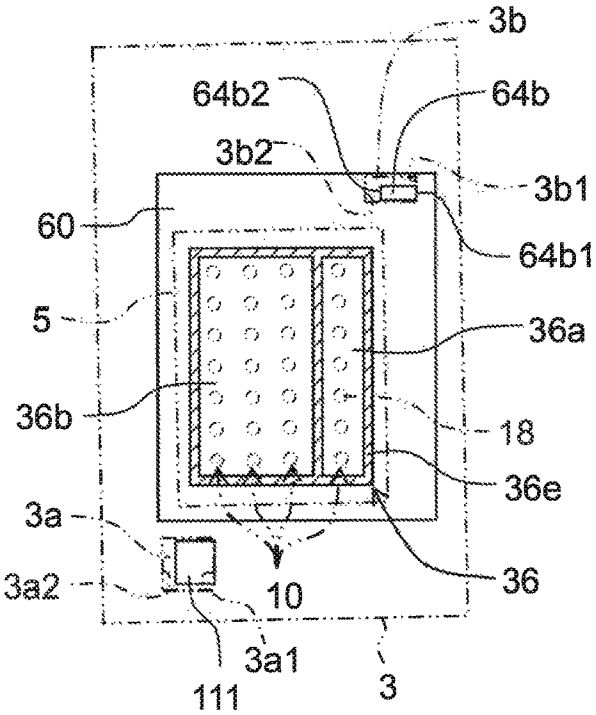
FIG. 18A is a view depicting a state after the state depicted in FIG. 17A, in a case of an embodiment (wherein a rib is present)

In contrast, in the embodiment, the rib 64*b* is provided on the cap lift holder 60 which is movable integrally with the nozzle cap 36 in the horizontal plane. Accordingly, as depicted in FIG. 18A, until the contact surface 64*b*1 of the rib 64*b* makes contact with the inner wall surface 3*b*1 of the recessed portion 3*b*, the carriage 3 and the nozzle cap 36 move relative to each other in the horizontal plane. However, after the contact surface 64*b*1 has made contact with the inner wall surface 3*b*1, the rib 64*b* is pressed (pushed) leftwardly by the carriage 3, to thereby rotate the carriage 3 integrally with the nozzle cap 36 in the horizontal plane, as depicted in FIG. 18B. With this, the positional relationship in the scanning direction between the ink-jet head 5 and the nozzle cap 36 is not changed, thereby making it possible to prevent the lip portion 36*e* from making contact with the nozzles 18. Note that in the embodiment, the inner wall surfaces 3*b*1 and 3*b*2 cross the rotational direction of the carriage 3 in this situation.

Further, in the embodiment, the carriage locker 111 is located on the downstream side in the conveyance direction with respect to the frame portion 71 accommodating the nozzle cap 36, etc., and thus the carriage locker 111 is located on the downstream side in the conveyance direction with respect to the ink-jet head 5. Furthermore, the rib 64*b* is located on the upstream side in the conveyance direction with respect to the nozzle cap 36, and thus the rib 64*b* is located on the upstream side in the conveyance direction with respect to the plurality of nozzles 18. Moreover, due to these points, the rib 64*b* is separated away farther from the carriage locker 111 in the third direction (conveyance direction) than the plurality of nozzles 18. Moreover, as described above, the spacing distance K1 in the scanning direction between the contact surface 64*b*1 of the rib 64*b* and the inner wall surface 3*b*1 of the recessed portion 3*b* is smaller than the spacing distances J1 and J3 in the scanning direction each of which is between the lip portion 36*e* and the nozzle row 10. Accordingly, it is possible to prevent the lip portion 36*e* from making contact with the nozzles 18 due to the rotation of the carriage 3 which is generated until the contact surface 64*b*1 makes contact with the inner wall surface 3*b*1.

Further, in the embodiment, the carriage locker 111 is located on the downstream side in the conveyance direction with respect to the ink-jet head 5, whereas the rib 64*b* is located on the upstream side in the conveyance direction with respect to the ink-jet head 5. Furthermore, the carriage 3 is heaviest at a portion thereof in which the ink-jet head 5 is arranged, and the center of gravity of the carriage 3 is located at the portion thereof in which the ink-jet head 5 is arranged. Due to these points, in the embodiment, the carriage locker 111 is located on the downstream side in the conveyance direction with respect to the center of gravity of the carriage 3, and the rib 64*b* is located on the upstream side in the conveyance direction with respect to the center of gravity of the carriage 3. Namely, in the conveyance direction, the carriage locker 111 and the rib 64*b* are located so as to sandwich the center of gravity of the carriage 3. With this, in a case that the contact surface 64*b*1 of the rib 64*b* makes contact with the inner wall surface 3*b*1 of the recessed portion 3*b*, the carriage 3 and the nozzle cap 36, the cap holder 50 and the cap lift holder 60 rotate integrally.

Note that although the case wherein the leftward external force in the scanning direction is applied to the carriage 3 has been explained here, this is similarly applicable also to such a case that a rightward external force in the scanning direction is applied to the carriage 3. In such a case, the carriage locker 111 makes contact with the inner wall surface 3*a*2 on the left side of the recessed portion 3*a*, to thereby prevent the carriage 3 from moving toward the right side in the scanning direction. Further, the carriage, of which rightward movement in the scanning direction is prevented, rotates clockwise with the carriage locker 111 as the supporting point. Furthermore, the contact surface 64*b*2 on the left side of the rib 64*b* makes contact with the inner wall surface 3*b*2 on the left side of the recessed portion 3*b*, thereby causing the carriage 3 and the nozzle cap 36 to rotate integrally. Moreover, in this case, the rib 64*b* is separated away farther from the carriage locker 111 in the conveyance direction than the plurality of nozzles 18; the spacing distance K2 in the scanning direction between the contact surface 64*b*2 of the rib 64*b* and the inner wall surface 3*b*2 of the recessed portion 3*b* is smaller than the spacing distances J2 and J4 in the scanning direction each of which is between the lip portion 36*e* and the nozzle row 10. Accordingly, it is possible to prevent the lip portion 36*e* from making contact with the nozzles 18 due to the carriage 3 which is rotating until the contact surface 64*b*2 makes contact with the inner wall surface 3*b*2.

Here, there is presumed such a case that a carriage locker is provided on the cap lift holder 60, unlike the present embodiment. In this case, the movement of the carriage 3 is prevented by the carriage locker; when the carriage 3 rotates, the cap lift holder 60 provided with the carriage locker can be rotated integrally with the nozzle cap 36. However, since the carriage locker is configured to receive the force from the carriage 3 and to prevent the movement of the carriage 3, it is necessary that the length W in the up/down direction of the overlapping portion, of the carriage locker, overlapping with the inner wall surface 3*a*1 of the recessed portion 3*a* in the capping state to be long to a certain extent. On the other hand, similarly to the case that the rib 64*b* is provided on the cap lift holder 60 wherein the rib 64*b* is easily inclined as described above, in a case that the carriage locker is provided on the cap lift holder 60, the carriage locker inclines easily. Accordingly, in such a case, considering any inclination of the carriage locker, it is necessary to start the movement of the carriage 3 after having the nozzle cap 36 to be descended in an amount greater than a descending amount by which the nozzle cap 36 is moved in a case that the carriage locker does not incline. As a result, a time after the print instruction is inputted and until the carriage 3 is allowed to be moved so as to start the printing becomes long. In view of this, the present embodiment makes the time after the print instruction is inputted and until the movement of the carriage 3 can be started to be short by providing the carriage locker 111 on the cap lift base 70 as described above.

In view of the above-described points, the present embodiment provides the carriage locker 111 on the cap lift base 70 to thereby shorten, in the printer 1, the time after the print instruction is inputted and until the movement of the carriage 3 can be started to be short, while providing the rib 64*b* on the cap lift holder 60 so as to prevent the lip portion 36*e* from making contact with the nozzles 18 even when any external force in the scanning direction is applied to the carriage 3.

Further, in the embodiment, the carriage locker 111 is configured to receive the force from the carriage 3 so as to prevent the movement of the carriage 3 in the scanning direction, and thus the carriage locker 111 is required to have a strength that is high to a certain extent. On the other hand, in a case that the carriage 3 of which movement is prevented by the carriage locker 111 rotates with the carriage locker 111 as the supporting point, the rib 64*b* is configured to make contact with the inner wall surfaces 3*b*1 and 3*b*2 of the recessed portion 3*b* of the carriage 3 to thereby cause the carriage 3 and the nozzle cap 36 to integrally rotate. Accordingly, the force received by the rib 64*b* is small as compared with the force received by the carriage locker 111. Therefore, the rib 64*b* is not required to have a strength as high as that of the carriage locker 111.

Figure 9A:
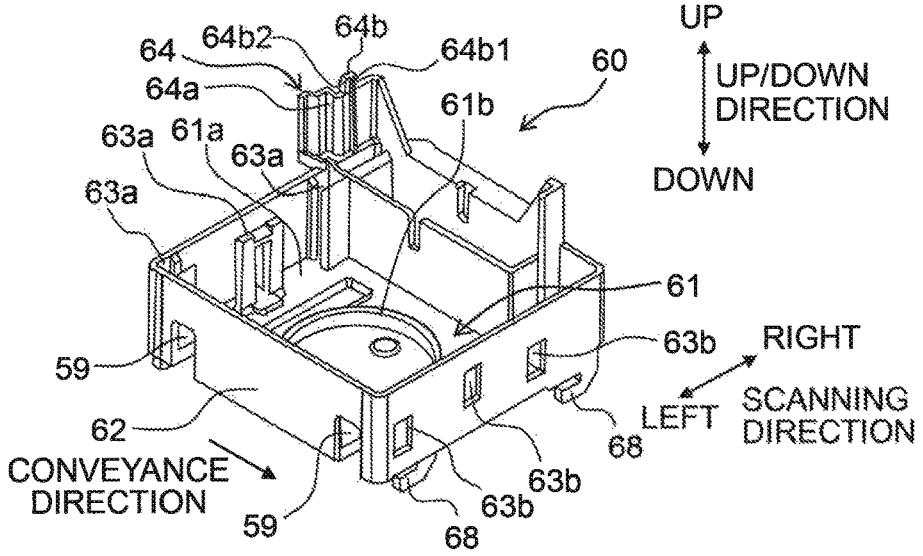
FIG. 9A is a perspective view of a cap lift holder corresponding to FIG. 4.
Figure 9B:
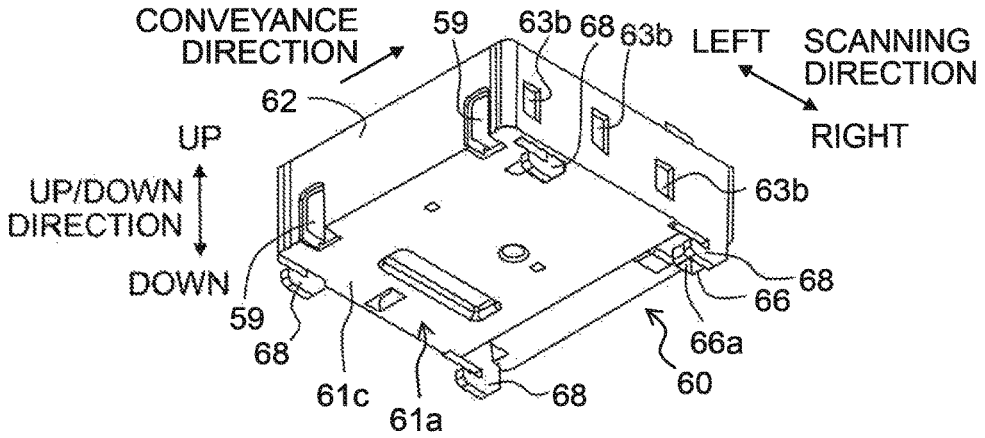
FIG. 9B is a perspective view of the cap lift holder, as seen from a different direction from that in FIG. 9A.
Figure 9C:
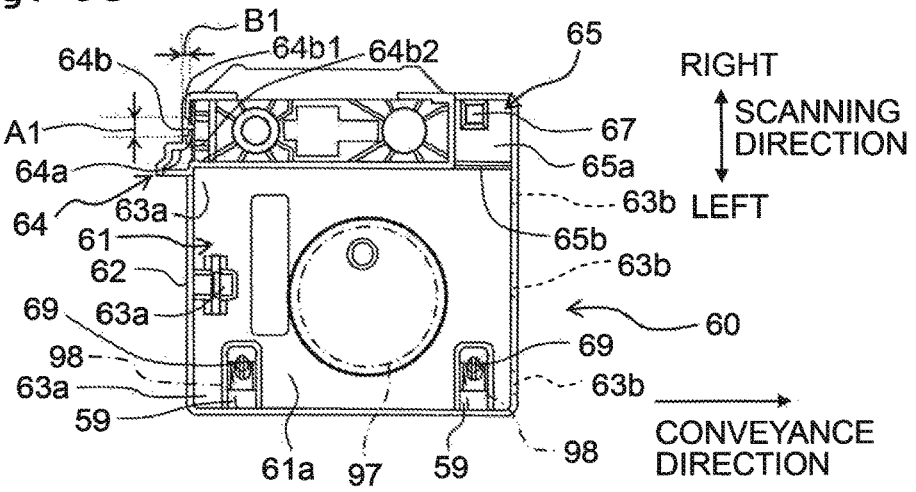
FIG. 9C is a plane view of the cap lift holder.
Figure 10A:
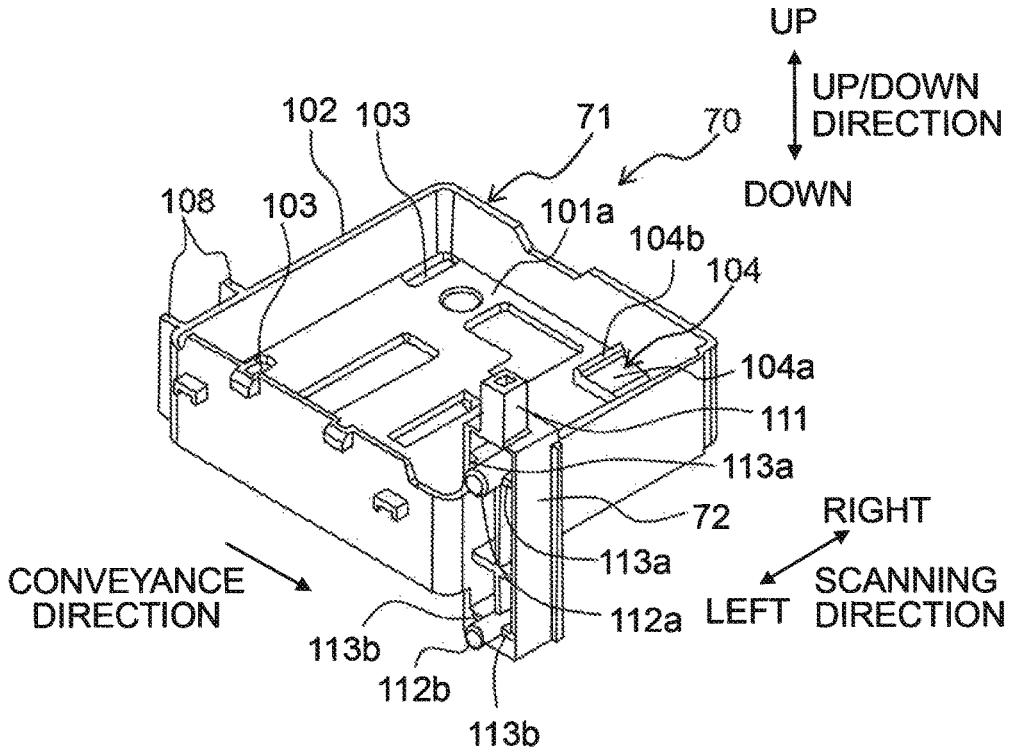
FIG. 10A is a perspective view of a cap lift base corresponding to FIG. 4.
Figure 10B:
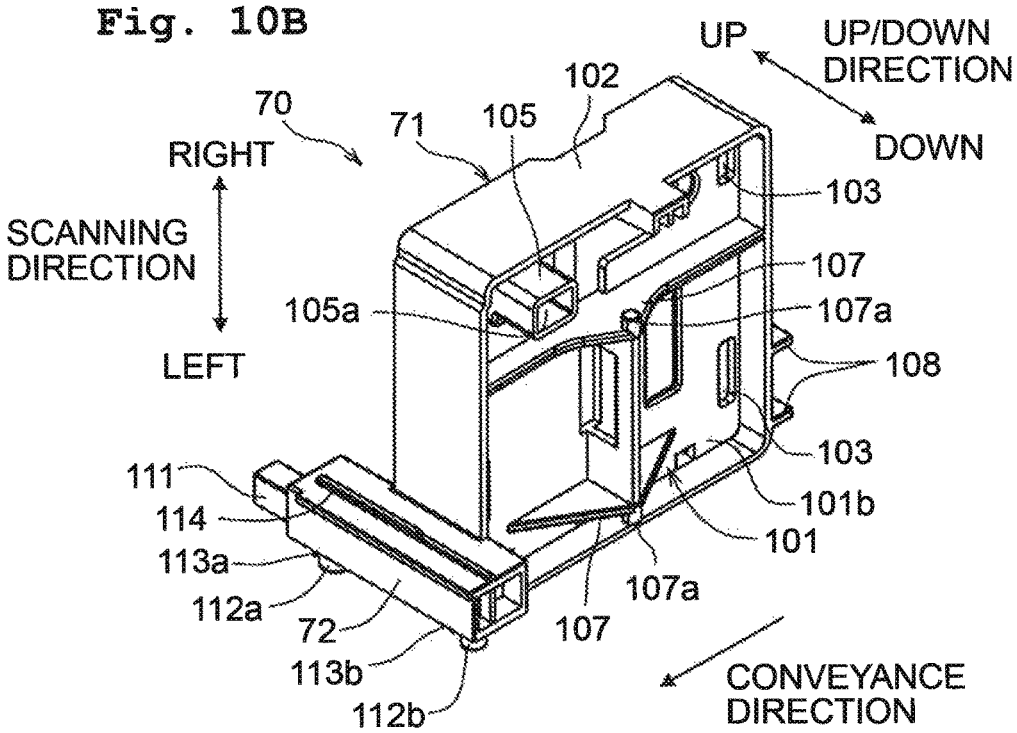
FIG. 10B is a perspective view of the cap lift base, as seen from a different direction from that in FIG. 10A.
Figure 11A:
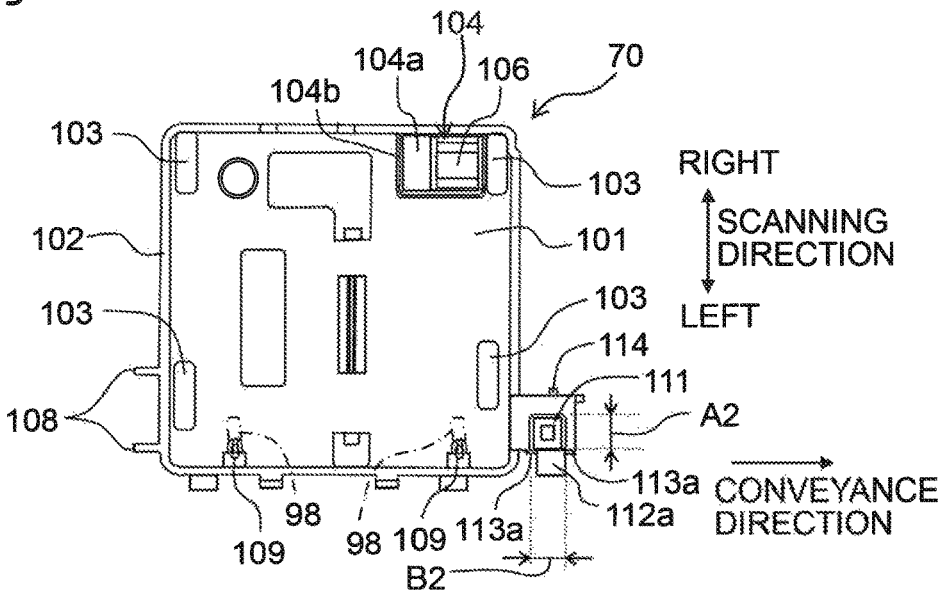
FIG. 11A is a plane view of the cap lift base.
Figure 11B:
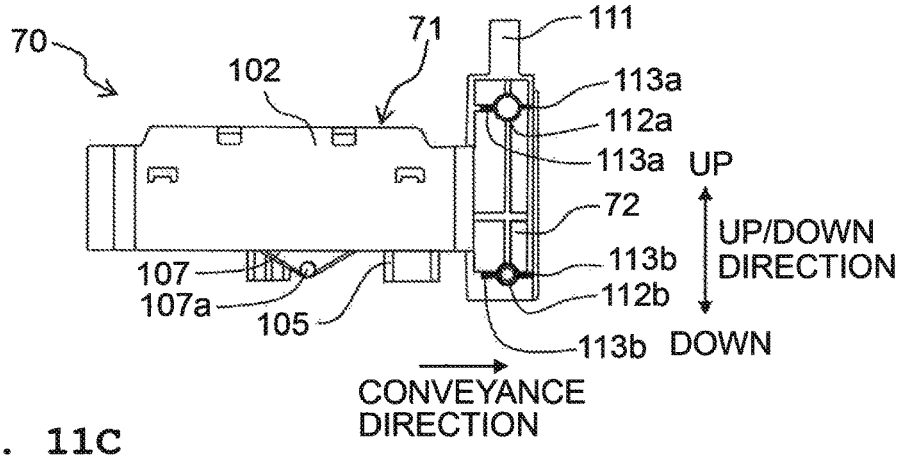
FIG. 11B is a side view of the cap lift base as seen from the left side.
Figure 11C:
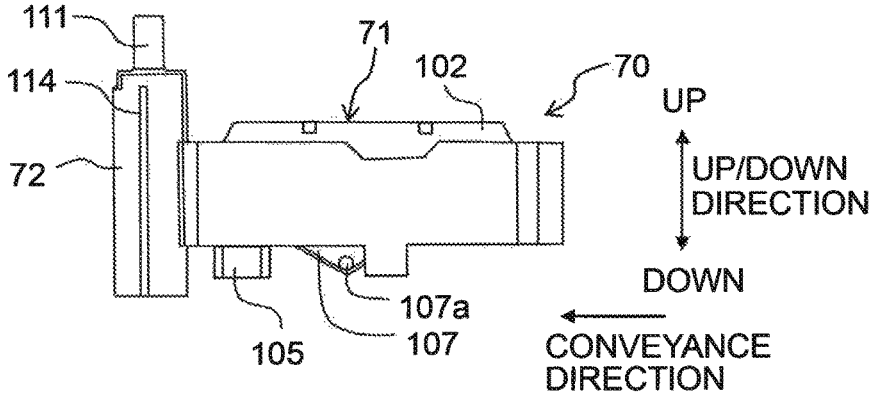
FIG. 11C is a side view of the cap lift base as seen from the right side.
Figure 12A:
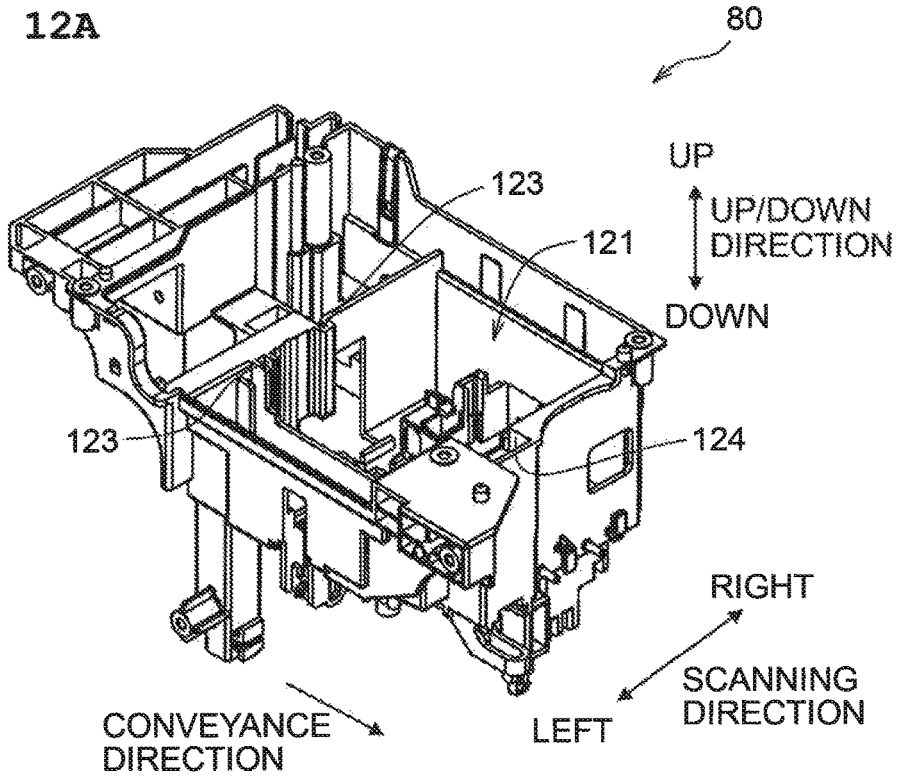
FIG. 12A is a perspective view of a base member corresponding to FIG. 4.
Figure 12B:
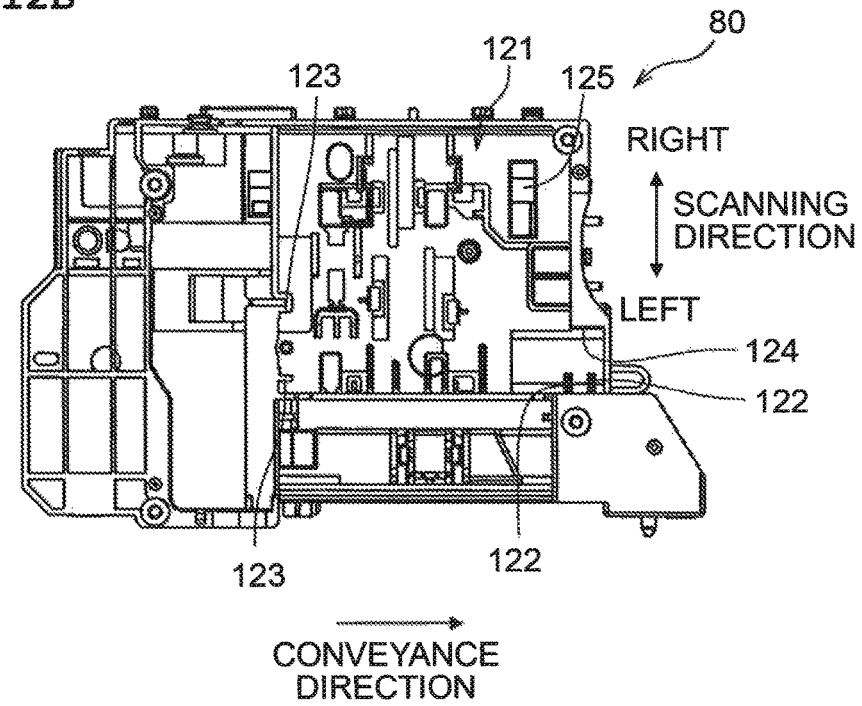
FIG. 12B is a perspective view of the base member, as seen from a different direction from that in FIG. 12A.
Figure 16:
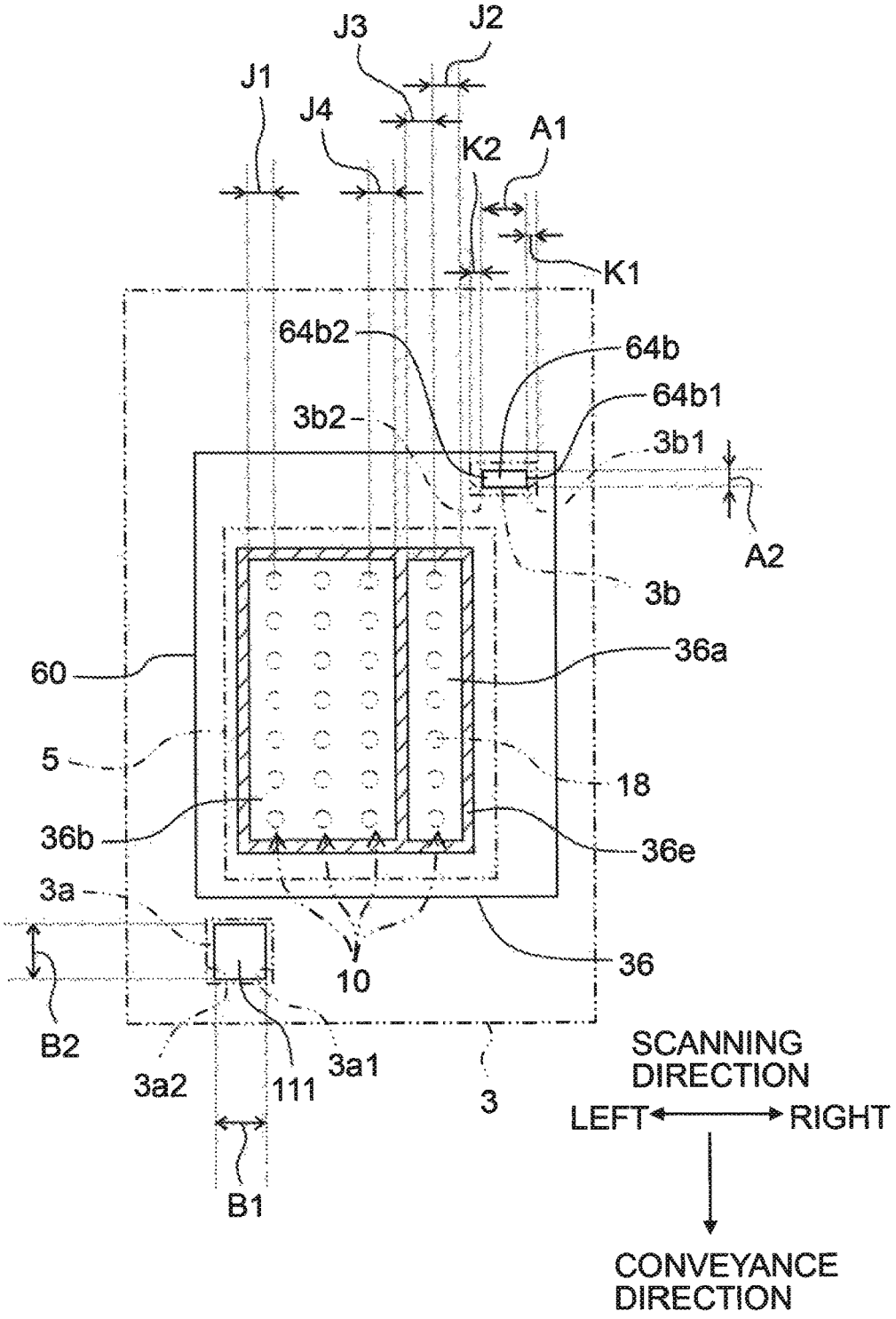
FIG. 16 is a schematic view for explaining the positional relationship among the carriage, the nozzle cap and the cap lift holder as seen thereabove in the capping state.

In view of this, the present embodiment makes a length A1 in the scanning direction of the rib 64*b* to be shorter than a length A2 in the scanning direction of the carriage locker 111, and makes a length B1 in the conveyance direction of the rib 64*b* to be shorter than a length B2 in the conveyance direction of the carriage locker 111, as depicted in FIGS. 9A, 11A and 16, thereby making a projected area in the up/down direction of the rib 64*b* to be smaller than a projected area in the up/down direction of the carriage locker 111. With this, it is possible to realize a small-sized rib 64*b*, and to suppress the enlargement of the printer 1 as a whole.

Further, in the embodiment, the cap lift base 70, on which the carriage locker 111 required to have a high strength is provided, is formed of a material having a hardness higher than that forming the cap lift holder 60 on which the rib 64*b*, not required to have much high strength, is provided. With this, it is possible to make the strength of the carriage locker 111 to be high. Furthermore, in the embodiment, in a case that the carriage 3 makes contact with the positioning surface 64*a* to be thereby positioned with respect to the inclination of the ink-jet head 5, the cap lift holder 60 rotates in the horizontal plane together with the nozzle cap 36 and the cap holder 50. In this situation, the cap lift holder 60 slidably moves with respect to the ink-jet head 5. Accordingly, the cap lift holder 60 cannot be composed of a material having a much high strength. Accordingly, in the embodiment, the cap lift holder 60 is composed of a material of which hardness is lower than that of the cap lift base 70.

The switching device 33 is connected to the suction pump 32 via the tube, in addition that the switching device 33 is connected to the cap portions 36*a* and 36*b* and to the exhaust cap 37 as described above. The switching device 33 performs switching among the connection of the suction pump 37 with the cap portion 36*a* or 36*b* and the connection of the suction pump 37 with the exhaust cap 37. The waste liquid tank 34 is connected to a portion, of the suction pump 32, on the opposite side with respect to the switching device 33. Further, in the printer 1, the controller 100 performs such a control that any one of the cap portions 36*a* and 36*b* is connected to the suction pump 32 and the suction pump 32 is driven, thereby making it possible to perform a suction purge for causing the ink inside the ink-jet head 5 to be jetted (discharged) from the nozzles 18 to any one of the cap portions 36*a* and 36*b*. Furthermore, after the suction purge, the nozzle cap 36 is located at the intermediate position and then the suction pump 32 is driven, thereby making it possible to execute an empty suction for causing a liquid (fluid) remaining in the cap portion 36*a* or 36*b* to be discharged therefrom. Moreover, in the capping state, the exhaust cap 37 is connected to the suction pump 32 and then the suction pump 32 is driven, thereby making it possible to execute an exhaust purge for causing the air to be discharged from the exhaust channels 26. The ink jetted (discharged) by the suction purge and the empty suction is stored in the waste liquid tank 34.

Next, an explanation will be given about modifications to which a various kinds of changes are added to the embodiment of the present teaching.

In the above-described embodiment, in the capping state, there is the magnitude relationship of $Y<Z<X$ among the length X of the overlapping portion of the carriage 3 overlapping with the positioning surface 64*a*, the length Y in the up/down direction of the overlapping portion of the contact surface 64*b*1 of the rib 64*b* overlapping with the inner wall portion 3*b*1 of the recessed portion 3*b*, and the moving amount Z in the up/down direction of the cap lift holder 60 in the case that the nozzle cap 36 is moved from the retracted position up to the capping position. However, there is no limitation to this.

Figure 19A:
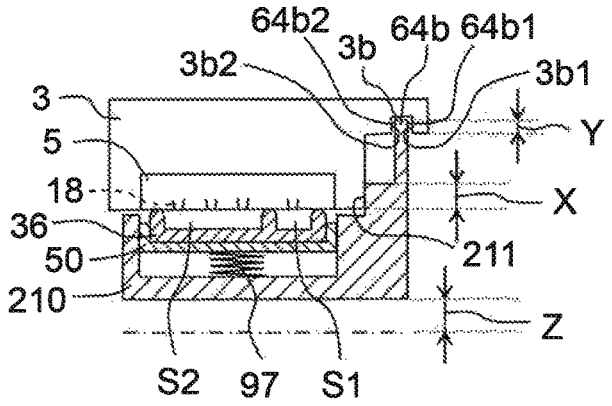
FIG. 19A is a view of a modification, corresponding to FIG. 14A.

For example, as depicted in FIG. 19A, a cap lift holder 210 has an upper end portion of a positioning surface 211 which is located at a position below that of the positioning surface 64*a* (see FIG. 14A) of the embodiment. With this, in the capping state, there is a magnitude relationship of $Z>X>Y$ among a length X of the overlapping portion of the carriage 3 overlapping with the positioning surface 211, a length Y in the up/down direction of the overlapping portion of the contact surface 64*b*1 of the rib 64*b* overlapping with the inner wall portion 3*b*1 of the recessed portion 3*b*, and a moving amount Z in the up/down direction of the cap lift holder 210 in the case that the nozzle cap 36 is moved from the retracted position up to the capping position.

Figure 19B:
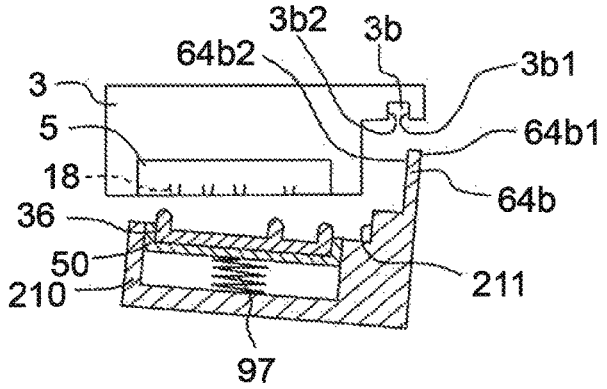
FIG. 19B is a view of the modification, corresponding to FIG. 14C.
Figure 19C:
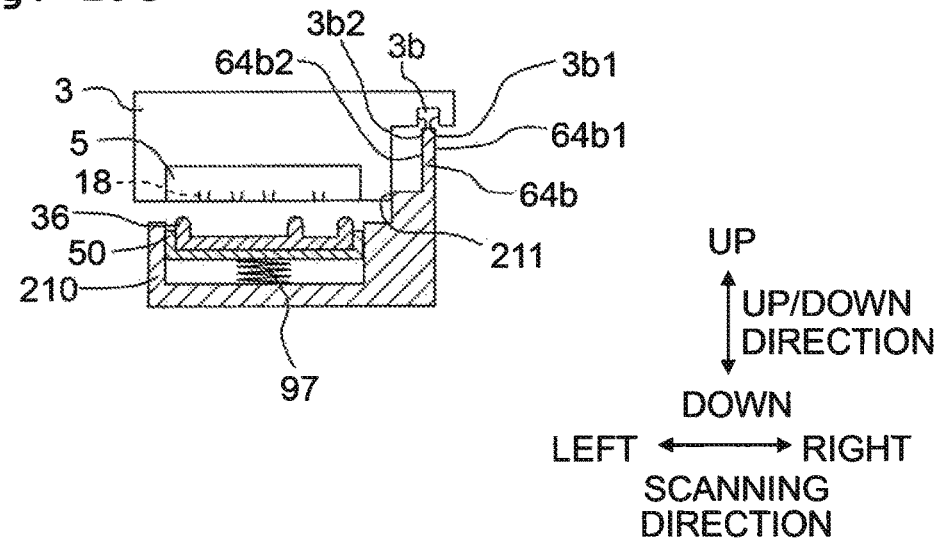
FIG. 19C is a view of the modification, depicting a state in which the nozzle cap, etc. are moved upwardly from the state depicted in FIG. 19A.

In this case, at a stage that the carriage 3 is moved to the maintenance position, the carriage 3 does not make contact with the positioning surface 211 as depicted in FIG. 19B, and the nozzle cap 36, the cap holder 50 and the cap lift holder 210 are remained to be inclined, in some cases. However, also in this modification, there is the magnitude relationship of $X>Y$; in a case that the nozzle cap 36, the cap holder 50 and the cap lift holder 210 are ascended from the state depicted in FIG. 19B, then as depicted in FIG. 19C, the positioning surface 211 makes contact with the carriage 3 before the rib 64*b* reaches the recessed portion 3*b*, and thus the nozzle cap 36, the cap holder 50 and the cap lift holder 210 are positioned with respect to the carriage 3. Then, after this positioning, the rib 64*b* reaches the recessed portion 3*b*, thereby making it possible to prevent the rib 64*b* from interfering with the carriage 3.

Further, it is allowable that in the capping state, the length X of the overlapping portion of the carriage 3 overlapping with the positioning surface 64*a* is shorter than the length Y in the up/down direction of the overlapping portion of the contact surface 64*b*1 of the rib 64*b* overlapping with the inner wall portion 3*b*1 of the recessed portion 3*b*. Also in this case, provided that the inclination of the nozzle cap 36, the cap holder 50 and the cap lift holder 60 with respect to the posture thereof in the capping state is small, the rib 64*b* does not interfere with the carriage 3.

Furthermore, in the above-described embodiment, the spacing distance K1 in the scanning direction between the contact surface 64*b*1 of the rib 64*b* and the inner wall surface 3*b*1 of the recessed portion 3*b*, and the spacing distance K2 in the scanning direction between the contact surface 64*b*2 of the rib 64*b* and the inner wall surface 3*b*2 of the recessed portion 3*b* are smaller than the spacing distances J1 to J4 each of which is the spacing distance between the lip portion 36*e* and one of the nozzle rows 10. However, there is no limitation to this. It is allowable that the spacing distance K1 is smaller than at least the spacing distances J1 and J3. Further, it is allowable that the spacing distance K2 is smaller than at least the spacing distances J2 and J4. Moreover, in a cases that the arrangement of the plurality of nozzles 18 is different from that in the embodiment as described above, then it is allowable that the spacing distances K1 and K2 are made to be smaller than a spacing distance in the scanning direction between the lip portion 36*e* and a nozzle 18, among the plurality of nozzles 18, which would be first to make contact with the lip portion 36*e* under a condition that the rib 64*b* were not provided and that the carriage 3 rotates with the carriage locker 111 as the supporting point.

Further, in the above-described embodiment, the carriage locker 111 and the rib 64*b* are located so as to sandwich the center of gravity of the carriage 3 in the conveyance direction. However, there is no limitation to this. For example, it is allowable that the carriage locker 111 and the rib 64*b* are located at positions, respectively, which are shifted in the conveyance direction but are on one side in the conveyance direction with respect to the center of gravity of the carriage 3.

Furthermore, it is also allowable that the carriage locker 111 and the rib 64*b* may be located at positions, respectively, which are same in the conveyance direction. Also in this case, an end surface in the conveyance direction of the rib 64*b* (an example of the "contact surface" of the present teaching) makes contact with an inner wall surface defining an end in the conveyance direction of the recessed portion 3*b* (an example of the "facing surface" of the present teaching), thereby making it possible to rotate the carriage 3, the nozzle cap 36, the cap holder 50 and the cap lift holder 60 integrally. Note that in this case, the inner wall surface defining the end in the conveyance direction of the recessed portion 3*b* crosses the rotational direction of the carriage 3.

Moreover, in the above-described embodiment, the portion of the carriage 3 forming the lower end portion of the recessed portion 3*a* and the portion of the carriage 3 forming the lower end of the recessed portion 3*b* are located at a substantially same height, whereas the forward end portion of the rib 64*b* is located at the position below the forward end portion of the carriage locker 111, thereby making the length Y in the up/down direction of the overlapping portion of the rib 64*b* overlapping with the recessed portion 3*b* in the capping state is shorter than the length W in the up/down direction of the overlapping portion of the carriage locker 111 overlapping with the recessed portion 3*a* in the capping state. However, there is no limitation to this.

For example, it is allowable that the forward end portion of the rib 64*b* and the forward end portion of the carriage locker 111 are positioned at a substantially same height, and that the portion of the carriage 3 forming he lower end portion of the recessed portion 3*a* may be located at a position above the portion of the carriage 3 forming the lower end portion of the recessed portion 3*b*. Also in this case, the length Y in the up/down direction of the overlapping portion of the rib 64*b* overlapping with the recessed portion 3*b* in the capping state is shorter than the length W in the up/down direction of the overlapping portion of the carriage locker 111 overlapping with the recessed portion 3*a* in the capping state.

Further, it is allowable that the length Y in the up/down direction of the overlapping portion of the rib 64*b* overlapping with the recessed portion 3*b* in the capping state is not less than the length W in the up/down direction of the overlapping portion of the carriage locker 111 overlapping with the recessed portion 3*a* in the capping state.

Furthermore, in the embodiment, the cap lift base 70 is formed of a material of which hardness is higher than the material forming the cap lift holder 60. However, there is no limitation to this. For example, the cap lift base 70 may be formed of a material same as that forming the cap lift holder 60. Further, it is allowable that the cap lift base 70 may be formed of a material of which hardness is lower than that forming the cap lift holder 60.

Moreover, in the embodiment, the carriage locker 111 is provided on the cap lift base 70. However, there is no limitation to this. For example, the carriage locker 111 may be provided on another portion or part, of the printer 1, which does not move integrally with the nozzle cap 36, such as the guiderail 12, etc.

Further, in the embodiment, the rib 64*b* has the projected area in the up/down direction which is smaller than the projected area in the up/down direction of the carriage locker 111. However, there is no limitation to this. It is allowable, for example, that at least one of the length in the scanning direction and the length in the conveyance direction of the rib 64*b* is longer than that or those of the carriage locker 111 such that the projected area in the up/down direction of the rib 64*b* is not less than the projected area in the up/down direction of the carriage locker 111.

Furthermore, in the embodiment, the rib 64*b* is provided on the cap lift holder 60. However, there is no limitation to this. For example, it is allowable that the cap holder 50 is provided with a rib which is accommodated in the recessed portion 3*b* in the capping state. Note that in this case, the cap holder 50 corresponds to the "first supporting member" of the present teaching.

Moreover, in the embodiment, the cap holder 50 and the cap lift holder 60 are separate members. However, there is no limitation to this. It is allowable that the cap holder 50 and the cap lift holder 60 are integrated to be provided as one member, rather than providing the cap holder 50 and the cap lift holder 60 as separate members. Note that in this case, the one member corresponds to the "first supporting member" of the present teaching.

Further, the rib 64*b* is not limited to or restricted to a rib provided on the member supporting the nozzle cap 36. The rib 64*b* may be provided directly on the nozzle cap 36.

Figure 20:
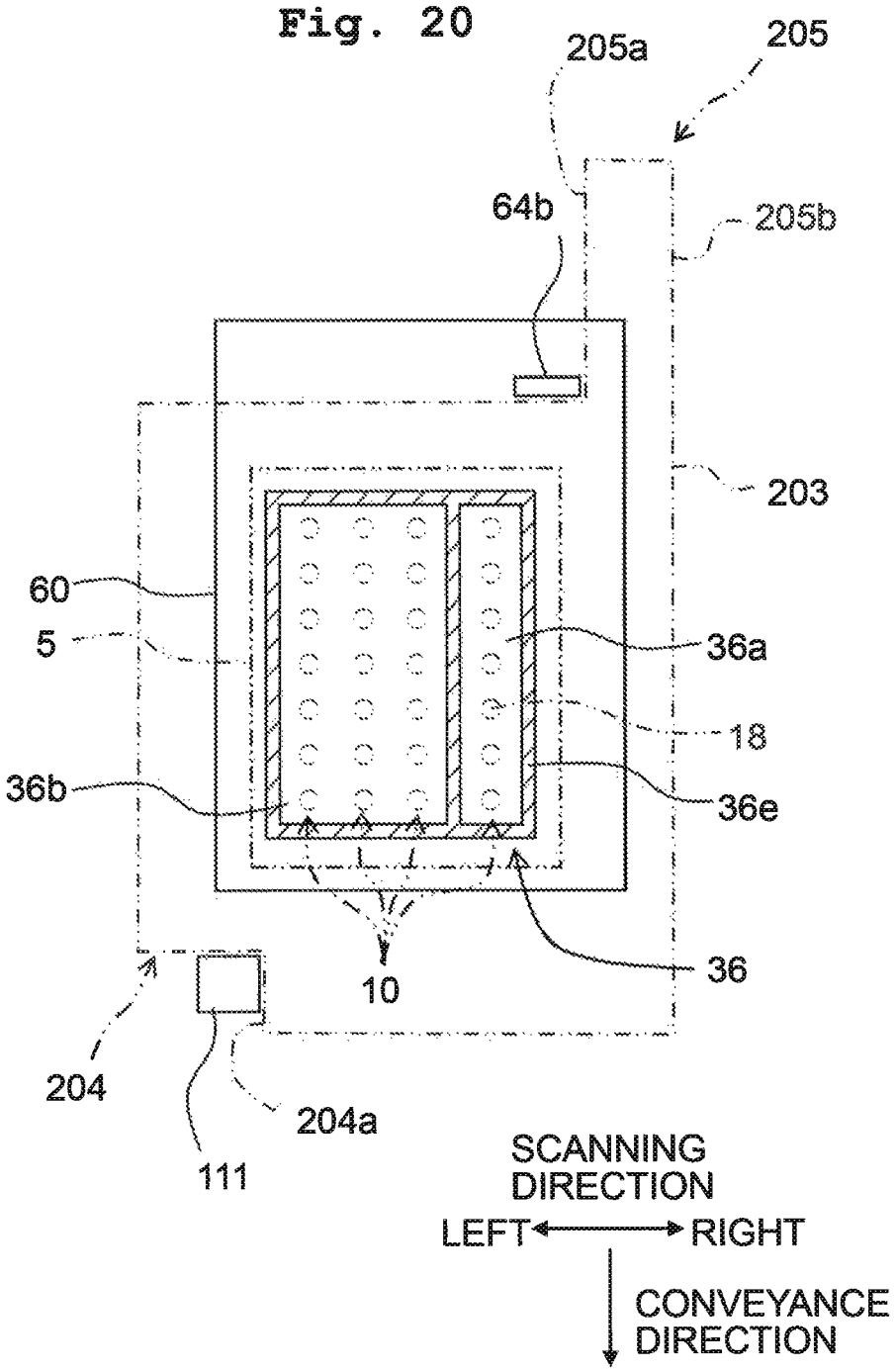
FIG. 20 is a view of a modification, corresponding to FIG. 16.

Furthermore, in the embodiment, the carriage locker 111 is configure to prevent the movement of the carriage 3 by making contact with the inner wall surfaces 3*a*1 and 3*a*2 of the recessed portion 3*a*. However, there is no limitation to this. For example, as depicted in FIG. 20, it is allowable that the recessed portion 3*a* is not formed in a carriage 203. The carriage 203 depicted in FIG. 20 has an L-shaped cutout portion 204 formed in a left side corner, of the carriage 203, in the scanning direction; and the carriage 203 is configured such that a side surface 204*a*, of the cutout portion 204, on the left side in the scanning direction makes contact with the carriage locker 111. By allowing the carriage locker 111 to make contact with the side surface 204*a* of the cutout portion 204 of the carriage 203, it is possible to prevent the movement of the carriage 203.

Moreover, in the above embodiment, the rib 64*b* is configured to cause the carriage 3 and the nozzle cap 36 to rotate integrally by making contact with the inner wall surfaces 3*b*1 and 3*b*2 of the recessed portion 3*b*. However, there is no limitation to this. For example, as depicted in FIG. 20, it is allowable that the recessed portion 3*b* is not formed in the carriage 203. The carriage 203 depicted in FIG. 20 has an extending portion 205 formed in a right side corner, of the carriage 203, in the scanning direction. The extending portion 205 has a surface 205*a* defining a portion of a side surface, of the carriage 203, on the left side in the scanning direction, and a surface 205*b* defining a portion of a right side surface, of the carriage 203. The surface 205*a* of the extending portion 205 is configured to make contact with the rib 64*b*. By allowing the rib 64*b* to make contact with the surface 205*a* of the extending portion 205 of the carriage 203, it is possible to rotate the carriage 203 and the nozzle cap 36 integrally. Note that in FIG. 20, the carriage 203 is provided with the extending portion 205 and the cutout portion 204, instead of being provided with the recessed portions 3*a* and 3*b* of the carriage 3. However, the present teaching is not limited to or restricted by such a configuration. For example, it is allowable that the carriage is provided with the recessed portion 3*b* and the cutout portion 205, or that the carriage is provided with the extending portion 204 and the recessed portion 3*a*.

Further, in the embodiment, the slide cam 90 connected to the cap lift base 70 is moved in the conveyance direction to thereby ascend/descend the nozzle cap 36, the cap holder 50, the cap lift holder 60 and the cap lift base 70. However, there is no limitation to this. It is also allowable that the printer is provided with a cap switching device configured to ascend/descend the nozzle cap 36 with a configuration, which is different from the configuration of the embodiment, thereby performing the switching between the capping state and the uncapping state.

Furthermore, in the embodiment, the nozzle cap 36, the cap holder 50, the cap lift holder 60 and the cap lift base 70 are moved in the up/down direction. It is allowable, however, to move the nozzle cap 36, the cap holder 50, the cap lift holder 60 and the cap lift base 70 in another direction which crosses the liquid jetting surface and which is inclined with respect to the up/down direction (an example of a "second direction" of the present teaching.

Moreover, in the description above, the explanation has been given about the example in which the present teaching is applied to the ink-jet printer configured to perform printing by jetting the inks from the nozzles. However, the example to which the present teaching is applicable is not limited to this. For example, the present teaching is also applicable to a liquid jetting apparatus configured to jet a liquid different from the ink(s), such as a material of a wiring pattern of a wiring board (liquid for a pattern material).

What is claimed is:

1. A liquid jetting apparatus configured to jet liquid toward a recording medium, comprising:

a liquid jetting head including a liquid jetting surface and a plurality of nozzles arranged in the liquid jetting surface;

a carriage on which the liquid jetting head is mounted, and which is movable along a guide rail extending in a first direction parallel to the liquid jetting surface;

a cap configured to cover the plurality of nozzles;

a cap switching device configured to move the cap relative to the liquid jetting head in a second direction crossing the liquid jetting head and to perform switching between a capping state and an uncapping state, the capping state being a state in which the cap is in contact with the liquid jetting head to cover the plurality of nozzles, and the uncapping state being a state in which the cap is separated away from the liquid jetting head;

a carriage blocker configured to move between a first position at which the carriage blocker is not in contact with carriage, and a second position at which the carriage blocker is in contact with the carriage to block movement of the carriage in the first direction; and a contacting portion which is located, in the uncapping state, at a third position at which the contacting portion is not in contact with carriage, and which is located, in the capping state, at a fourth position at which, under a condition that the carriage, of which movement in the first direction is blocked by the carriage blocker located at the second position, rotates around an axis perpendicular to the liquid jetting surface with the carriage blocker as a supporting point, the contacting portion is capable of contacting the rotating carriage, wherein the contacting portion is configured to move integrally with the cap in a plane parallel to the liquid jetting surface.

2. The liquid jetting apparatus according to claim 1, wherein in association with movement of the cap in the second direction, the carriage blocker is located at the first position in a case that the cap is in the uncapping state, and the carriage blocker is located at the second position in a case that the cap is in the capping state.

3. The liquid jetting apparatus according to claim 1, further comprising a platen, wherein the platen, the carriage blocker and the cap are arranged in this order in the first direction, wherein the contacting portion has a contact surface which faces in the first direction and which does not face the platen.

4. The liquid jetting apparatus according to claim 1, further comprising a power source configured to supply a power to drive the cap switching device.

5. The liquid jetting apparatus according to claim 1, wherein the contacting portion includes a first contactable portion, wherein the carriage blocker includes a second contactable portion, and wherein a length in the second direction of the first contactable portion which is capable of contacting the carriage is shorter than a length in the second direction of the second contactable portion, which is capable of contacting the carriage.

6. The liquid jetting apparatus according to claim 1, wherein the second direction is a direction along a vertical direction, a forward end portion of the carriage blocker and a forward end portion of the contacting portion are located to be above the cap, and the forward end portion of the contacting portion is located to be above the forward end portion of the carriage blocker.

7. The liquid jetting apparatus according to claim 1, wherein a position in a third direction, which is parallel to the liquid jetting surface and which crosses the first direction, of the carriage blocker and a position in the third direction of the contacting portion are shifted from each other.

8. The liquid jetting apparatus according to claim 7, wherein the carriage blocker and the contacting portion are located to sandwich, in the third direction, center of gravity of the carriage.

9. The liquid jetting apparatus according to claim 7, wherein a plurality of nozzle rows, each including the plurality of nozzles which are aligned in the third direction, are arranged side by side in the first direction in the liquid jetting head, the cap has a lip portion configured to contact the liquid jetting head, the carriage has a facing surface which faces the contacting portion in the first direction to make contact with the contacting portion in the capping state, in the capping state, the contacting portion is separated away from the carriage blocker in the third direction farther than the plurality of nozzles, and in the capping state, a spacing distance between the contacting portion and the facing surface in the first direction is smaller than a spacing distance between the lip portion and a nozzle row which is included in the plurality of nozzle rows and which is closest to the lip portion in the first direction.

10. The liquid jetting apparatus according to claim 1, wherein the cap switching device includes:

a first supporting member configured to support the cap and to move integrally with the cap in the plane parallel to the liquid jetting surface;

a second supporting member configured to move in the second direction and to rotatably support the first supporting member in the plane parallel to the liquid jetting surface; and a guide portion configured to guide the second supporting member in the second direction and to block rotation of the second supporting member with the first direction as an axis of rotation, the carriage blocker is disposed on the second supporting member, and the contacting portion is disposed on the first supporting member.

11. The liquid jetting apparatus according to claim 10, wherein the carriage has a facing surface which faces the contacting portion in the first direction to make contact with the contacting portion in the capping state;

the first supporting member has a positioning surface configured to perform positioning with respect to the carriage by facing the carriage in the first direction and contacting the carriage in the capping state; and in the capping state, a first length which is a length in the second direction of an overlapping portion between the carriage and the positioning surface is longer than a second length which is a length in the second direction of an overlapping portion between the contacting surface and the facing surface.

12. The liquid jetting apparatus according to claim 11, wherein the first length is longer than a third length which is a moving distance in the second direction of the first supporting member in a case that the cap is moved by the cap switching device to perform switching from the uncapping state to the capping state; and the second length is shorter than the third length.

13. The liquid jetting apparatus according to claim 10, wherein the second supporting member is composed of a material of which hardness is higher than that of a material composing the first supporting member.

14. The liquid jetting apparatus according to claim 1, wherein the contacting portion has a projected area, obtained in a case that the contacting portion is projected in a direction orthogonal to the liquid jetting surface, is smaller than that of the carriage blocker.

* * * * *